US009778612B2

(12) United States Patent
Ohmura et al.

(10) Patent No.: US 9,778,612 B2
(45) Date of Patent: Oct. 3, 2017

(54) IMAGE FORMING APPARATUS INCLUDING CHARGE REMOVING NEEDLE AND LIGHT IRRADIATOR

(71) Applicants: Tomoya Ohmura, Kanagawa (JP); Satoru Uchida, Kanagawa (JP); Yuuki Nobuoka, Kanagawa (JP)

(72) Inventors: Tomoya Ohmura, Kanagawa (JP); Satoru Uchida, Kanagawa (JP); Yuuki Nobuoka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/140,923

(22) Filed: Apr. 28, 2016

(65) Prior Publication Data

US 2016/0320741 A1 Nov. 3, 2016

(30) Foreign Application Priority Data

Apr. 30, 2015 (JP) ..... 2015-093420
Jun. 5, 2015 (JP) ..... 2015-115116

(51) Int. Cl.
*G03G 21/00* (2006.01)

(52) U.S. Cl.
CPC ..... *G03G 21/0047* (2013.01); *G03G 21/0011* (2013.01)

(58) Field of Classification Search
CPC ..... G03G 21/08; G03G 21/0011; G03G 21/0047; G03G 321/06
See application file for complete search history.

(56) References Cited

U.S. PATENT DOCUMENTS 4,801,975 A * 1/1989 Kano ..... G03G 15/165 399/315
5,012,293 A * 4/1991 Aldrich ..... G03G 21/08 399/128

(Continued)

FOREIGN PATENT DOCUMENTS

JP 63225280 A * 9/1988
JP 64-015773 1/1989

(Continued)

OTHER PUBLICATIONS

U.S. Appl. No. 14/929,860, filed Nov. 2, 2015.

*Primary Examiner* — Francis Gray
(74) *Attorney, Agent, or Firm* — Oblon, McClelland, Maier & Neustadt, L.L.P.

(57) ABSTRACT

An image forming apparatus includes a rotatable image bearer, a transfer member, a cleaning member, a light irradiator, and a light transmissive member. The transfer member forms a transfer position at which a visible image on a surface of the image bearer is transferred to a recording medium conveyed through a conveyance path. The cleaning member forms a cleaning position at which a substance adhering to the surface of the image bearer after transfer is cleaned. The light irradiator is disposed at a back face side of the recording medium opposite a side at which the surface of the image bearer is disposed relative to the conveyance path. The light irradiator is configured to emit light onto the surface of the image bearer. The light is targeted between the transfer position and the cleaning position. The light transmissive member is disposed between the light irradiator and the image bearer.

21 Claims, 22 Drawing Sheets

(56) References Cited

U.S. PATENT DOCUMENTS

| | | | | |
|---|---|---|---|---|
| 5,870,650 | A | 2/1999 | Takahashi et al. | |
| 6,035,157 | A | 3/2000 | Takahashi et al. | |
| 6,167,230 | A | 12/2000 | Kimura et al. | |
| 2005/0025520 | A1 | 2/2005 | Murakami et al. | |
| 2012/0014705 | A1* | 1/2012 | Nishida | G03G 15/657 399/66 |
| 2013/0051828 | A1 | 2/2013 | Yogosawa et al. | |
| 2014/0219693 | A1 | 8/2014 | Uchida | |
| 2015/0030351 | A1* | 1/2015 | Wakayama | G03G 21/08 399/128 |
| 2015/0268626 | A1 | 9/2015 | Saito et al. | |
| 2015/0346652 | A1 | 12/2015 | Ohmura | |
| 2016/0033922 | A1* | 2/2016 | Nodera | G03G 21/08 399/128 |
| 2016/0041509 | A1 | 2/2016 | Sekiguchi et al. | |

FOREIGN PATENT DOCUMENTS

| | | |
|---|---|---|
| JP | 1-310374 | 12/1989 |
| JP | 7-044033 | 2/1995 |
| JP | 2002-072710 | 3/2002 |
| JP | 2002-278314 | 9/2002 |
| JP | 2004-258137 | 9/2004 |
| JP | 2005-037892 | 2/2005 |

* cited by examiner

IMAGE FORMING APPARATUS INCLUDING CHARGE REMOVING NEEDLE AND LIGHT IRRADIATOR

CROSS-REFERENCE TO RELATED APPLICATIONS

This patent application is based on and claims priority pursuant to 35 U.S.C. §119(a) to Japanese Patent Application No. 2015-093420, filed on Apr. 30, 2015 and Japanese Patent Application No. 2015-115116, filed on Jun. 5, 2015 in the Japan Patent Office, the entire disclosure of which each of is hereby incorporated by reference herein.

BACKGROUND

Technical Field

Aspects of the present disclosure relate to an image forming apparatus.

Related Art

In an electrophotography image forming apparatus, an electrostatic latent image is formed on the surface of an image bearer including a photoconductive layer, the electrostatic latent image is then developed with a charged developer and the image is transferred to a recording medium at a transfer position. In this configuration, a cleaning member is provided to clean off adhering substances, such as untransferred toner and paper dust, adhering to the image bearer. A strong electrostatic adhesion force between adhering substances and the image bearer however may result in insufficient cleaning. To solve this problem, a technique of emitting light from a light irradiator before cleaning onto the image bearer including the photoconductive layer to reduce the surface potential of the image bearer and thereby reducing the adhesion force between the image bearer and the adhering substances is proposed.

SUMMARY

In an aspect of this disclosure, there is provided an image forming apparatus that includes a rotatable image bearer, a transfer member, a cleaning member, a light irradiator, and a light transmissive member. The rotatable image bearer includes a photoconductive layer. The transfer member forms a transfer position at which a visible image on a surface of the image bearer is transferred to a recording medium conveyed through a conveyance path. The cleaning member forms a cleaning position at which a substance adhering to the surface of the image bearer after transfer at the transfer position is cleaned. The light irradiator is disposed at a back face side of the recording medium opposite a side at which the surface of the image bearer is disposed relative to the conveyance path. The light irradiator is configured to emit light onto the surface of the image bearer. The light is targeted between the transfer position and the cleaning position. The light transmissive member is disposed between the light irradiator and the image bearer.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
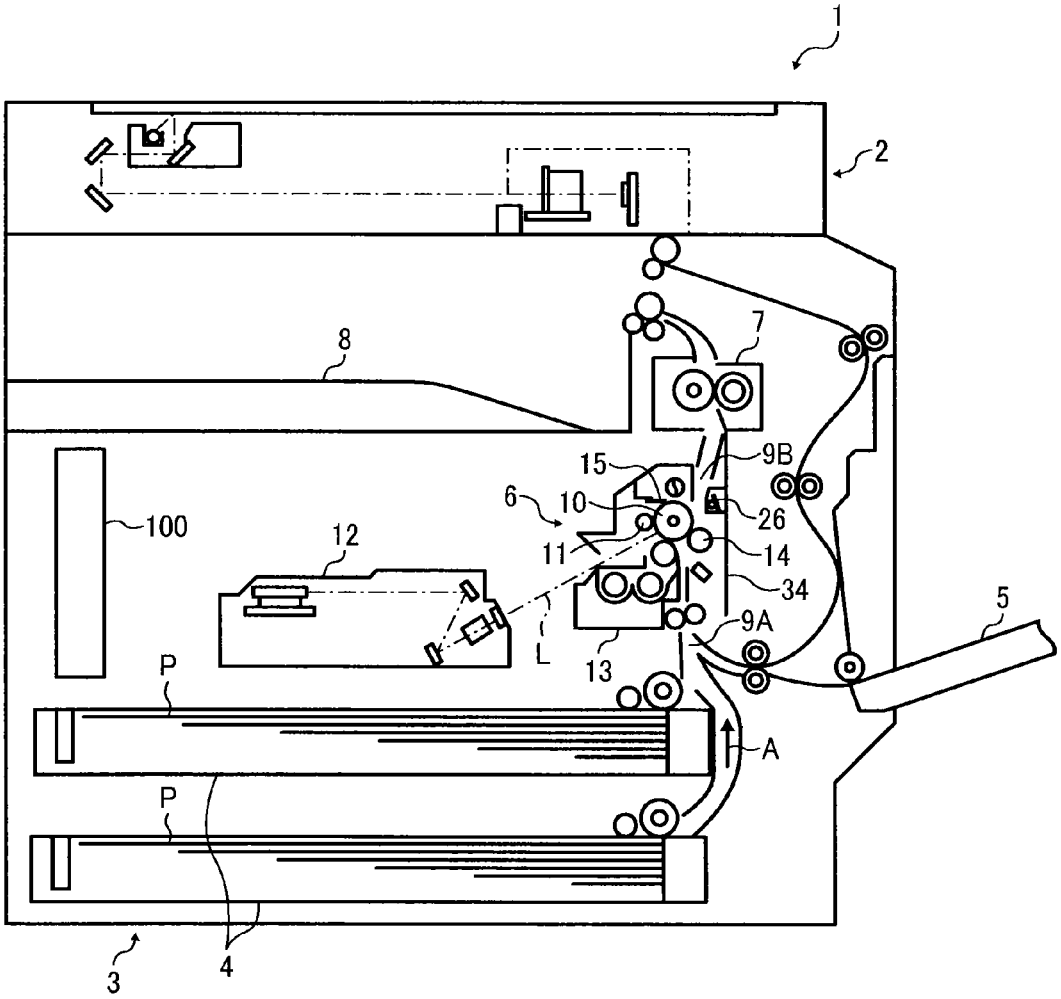
FIG. 1 is a schematic arrangement view illustrating an embodiment of an image forming apparatus according to the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Embodiments according to the present disclosure will hereinafter be described with reference to the attached drawings. In an image forming apparatus according to an embodiment of the present disclosure, a light irradiator emits light onto the surface of an image bearer including a photoconductive layer, before the image bearer is cleaned, to reduce potential of the image bearer and thereby reduces the adhesion force between adhering substances on the image bearer and the image bearer. For the embodiments, components having the same function and configuration are appended with the same reference code and repetitive description may be omitted. The figure in the drawing may partially be omitted as required to facilitate understanding of a configuration.

A copier 1 illustrated in FIG. 1, which is an image forming apparatus according to the embodiment, includes a scanner device 2 serving as an image reading device and a printer device 3 that forms an image on a sheet-type recording medium P from the image read from an original copy by the scanner device 2. A tray 4 serving as a sheet feeder that contains stacked recording mediums P or a bypass feeder 5 that accepts a manually fed recording medium P, an image forming unit 6 serving as a printer engine, a fixing device 7, and an optical writing device 12 are provided inside the printer device 3. A space is provided between the scanner device 2 and the printer device 3. In the upper part of the space above the printer device 3, a stack portion 8 on which ejected recording mediums P are stacked is provided. An upstream conveyance path 9A runs from the tray 4 or the bypass feeder 5 to the image forming unit 6, and a downstream conveyance path 9B runs from the image forming unit 6 to the fixing device 7. The recording medium P is conveyed through the upstream conveyance path 9A and the downstream conveyance path 9B. In FIG. 1, arrow A is allocated to the conveyance direction of the recording medium P (hereinafter referred to as recording-medium conveyance direction A).

Figure 2:
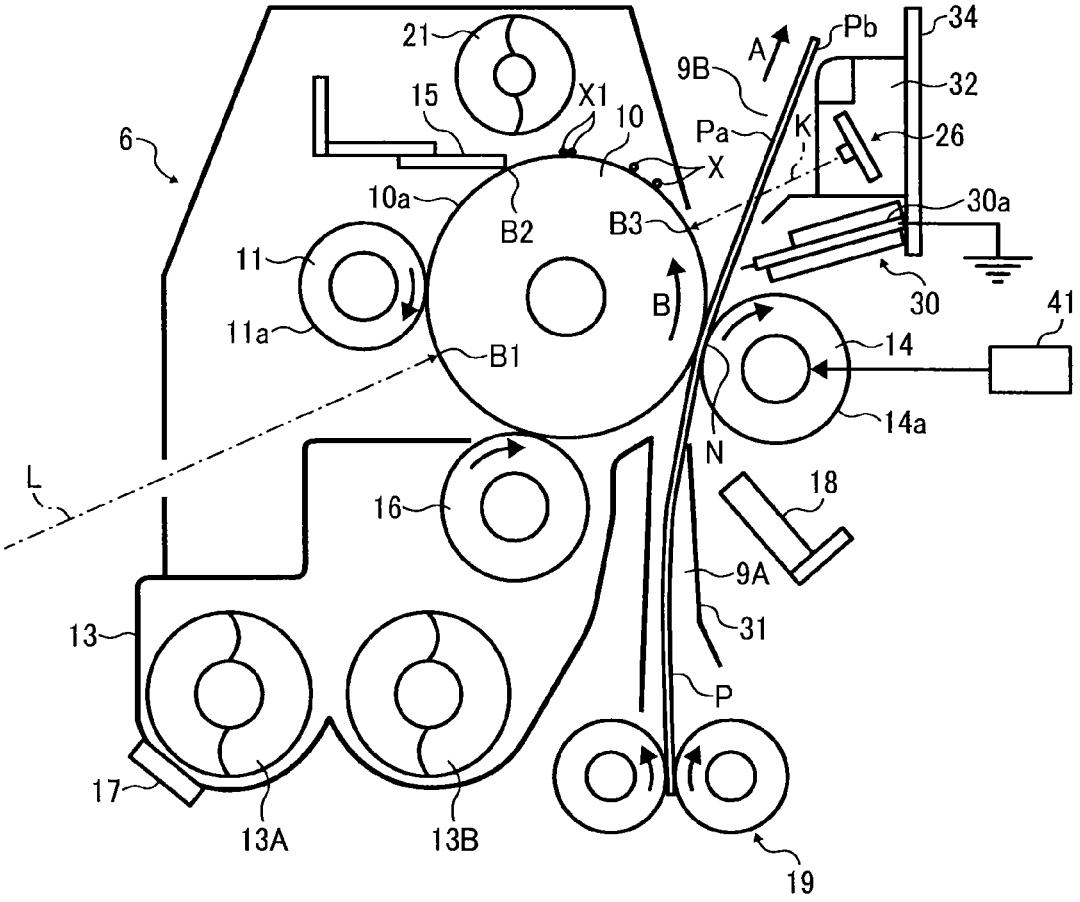
FIG. 2 is an enlarged view of an essential portion according to a first embodiment of the present disclosure.

As illustrated in FIG. 2, the image forming unit 6 includes a drum-shaped photoconductor 10 serving as an image bearer having a photoconductive layer on a surface 10*a*. The photoconductor 10 is supported by, for example, a side plate of the printer device 3, in a manner rotatable in a counter-clockwise direction in FIG. 2 (hereinafter referred to as photoconductor rotating direction B). A drive motor 40 serving as a drive source illustrated in FIG. 5 rotates the photoconductor 10 in the photoconductor rotating direction B. A charging roller 11 serving as a charger, a light-emission and exposure target B1 for a writing light L from the optical writing device 12 (see FIG. 1), a developing device 13, a transfer roller 14 serving as a transfer member, and a cleaning blade 15 serving as a cleaning member are arranged in series around the photoconductor 10 according to the electrophotographic process. The optical writing device 12 illustrated in FIG. 1 emits the writing light L, which is a laser light generated by a laser diode based on image date read from an original copy by the scanner device 2, onto the surface 10*a* of the photoconductor 10 (hereinafter referred to as photoconductor surface 10*a*) to perform optical scanning. An electrostatic latent image is formed on the photoconductor surface 10*a* by the optical scanning.

The embodiment employs the contact-transfer system in which a surface 14*a* of the rotatable transfer roller 14 contacts the photoconductor surface 10*a* to form a transfer nip N. A transfer bias is applied from a transfer-bias power source 41 to the transfer roller 14. The transfer roller 14 forms the transfer nip N as a transfer position at which a visible toner image formed on the photoconductor surface 10*a* is transferred, by application of a transfer bias, onto the recording medium P conveyed through the upstream conveyance path 9A. The transfer member may be a rotatable transfer brush instead of the transfer roller 14. The developing device 13 includes a developing sleeve 16 serving as a developer bearer that opposes the photoconductor surface 10*a* to supply toner, which is also a developer, to the electrostatic latent image, a toner sensor 17 serving as a developer density detector, and a pair of conveyance screws 13A and 13B serving as developer conveyors. In the developing device 13 configured as described above, the electrostatic latent image on the photoconductor surface 10*a* is developed to form a toner image. The reference code 18 is allocated to a P-sensor serving as an image density detector that detects toner density of the toner image formed on the photoconductor surface 10*a*. Paired registration rollers 19 that control the timing at which the recording medium P is conveyed to the transfer nip N is disposed on the upstream conveyance path 9A in the upstream of the transfer nip N in the recording-medium conveyance direction A. An upstream conveyance guide 31 is disposed between the paired registration rollers 19 and the transfer roller 14. The edge of the cleaning blade 15 is in contact with the photoconductor surface 10*a*. The cleaning blade 15 wipes off an adhering substance X, which is the remaining toner or aggregated toner adhering to the photoconductor surface 10*a*, and an adhering substance X1, which is the paper dust, with the rotation of the photoconductor 10. In the embodiment, the position at which the cleaning blade 15 contacts the photoconductor surface 10*a* is referred to as cleaning position B2. That is, the cleaning blade 15 forms the cleaning position B2 at which adhering substances X and X1 adhering to the photoconductor surface 10*a* after transferring image at the transfer nip N are cleaned off.

In this configuration, a surface 11*a* of the charging roller 11 is making contact with the photoconductor surface 10*a*, and a charge is supplied in a uniform manner to the photoconductor surface 10*a* by applying a charging bias to the charging roller 11 while the photoconductor 10 is rotated. The photoconductor surface 10*a* is thereby uniformly charged at a constant potential. The charged photoconductor surface 10*a* is irradiated with the writing light L from the optical writing device 12 to be optically scanned and thereby an electrostatic latent image is formed. As the photoconductor 10 rotates, the electrostatic latent image is developed with toner supplied from the developing sleeve 16 to turn into a toner image while passing the front of the developing sleeve 16 of the developing device 13. The recording medium P is fed from the tray 4 or the like and sent to the transfer nip N by the paired registration rollers 19. When the recording medium P passes the transfer nip N, the transfer effect (transfer electric field) of the transfer roller 14 transfers the toner image formed on the photoconductor surface 10*a* onto the recording medium P. The recording medium P with the toner image transferred thereon is conveyed to the fixing device 7 illustrated in FIG. 1, and the toner image is melted by heat and pressure to be fixed onto the recording medium P. After the fixing of the toner image, the recording medium P is sequentially ejected as an output image (duplication) and stacked on the stack portion 8.

The contact-transfer system employed in the embodiment will now be described. The transfer roller 14 is a transfer member of the contact-transfer system. When applied DC 1000 V under a moderate-temperature of 23° C. and a moderate humidity of 50% Rh, the resistance value of the transfer roller 14 is $10^6$ to $10^9\Omega$. The transfer bias supplied from the transfer-bias power source 41 to the transfer roller 14 is controlled by a constant current control. That is, in the embodiment, the transfer bias applied to the transfer roller 14 is adjusted so as a current flowing during the passage (printing) of a paper be constant. Basically, to transfer an image, a charge having an opposite polarity to the toner is applied to the back face Pb (backside face) of the recording medium P to electrically attract the toner image on the photoconductor surface 10*a* to a front face Pa of the recording medium P. The front face Pa of the recording medium P is a surface onto which the toner image is transferred that faces the photoconductor surface 10*a*. The back face Pb of the recording medium P is the opposite side of the front face Pa and does not face the photoconductor surface 10*a*. The adhering substances X and X1 remain on the photoconductor surface 10*a* after transfer. As the adhering substances X and X1 are sent by rotation of the photoconductor 10 to a cleaning position B2 at which the cleaning blade 15 is in contact with the photoconductor 10, and the adhering substances X and X1 are wiped off from the photoconductor surface 10*a* by the cleaning blade 15. The wiped-off adhering substances X and X1 are conveyed toward the developing device 13 by a collection conveyance screw 21 disposed near the cleaning blade 15. The conveyed substances are supplied again to the developing device 13 together with the fresh toner, namely, recycled.

First Embodiment

Figure 3:
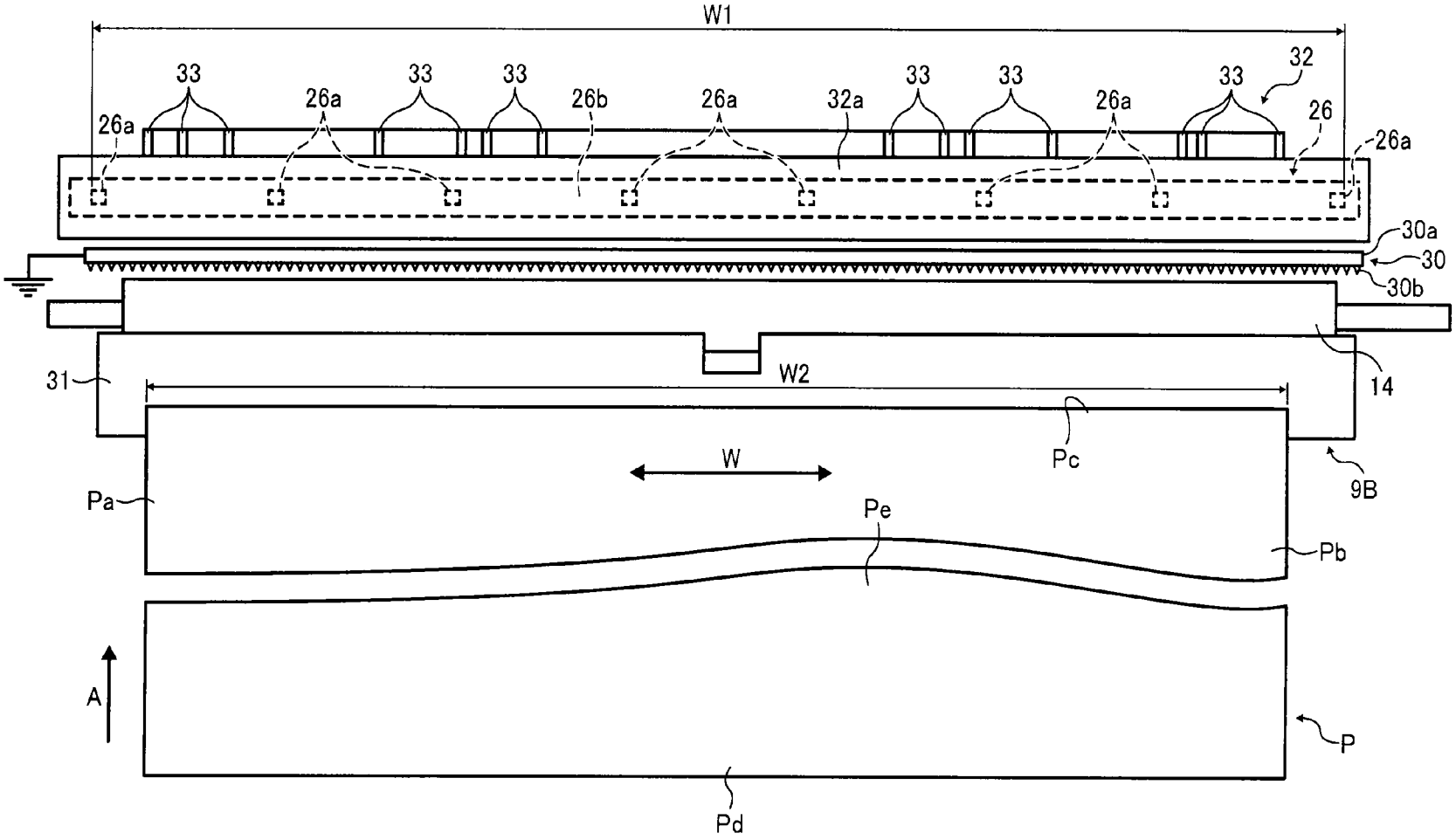
FIG. 3 illustrates a position and a schematic arrangement of a light irradiator.

The distinguishing arrangement and operation of a first embodiment will now be described. As illustrated in FIG. 2, a charge-removing light source 26 serving as a light irradiator and charge-removing device is disposed on a downstream conveyance path 9B in the downstream of a transfer nip N in a recording-medium conveyance direction A (the downstream in the recording-medium conveyance direction A). The charge-removing light source 26 emits a charge-removing light K to a photoconductor surface 10*a*, targeted to the downstream of the transfer nip N but to the upstream of a cleaning blade 15 in a photoconductor rotating direction B to reduce the surface potential of a photoconductor 10 before cleaning. As illustrated in FIG. 3, the charge-removing light source 26 includes a base plate 26*b* and a light source portion 26*a* disposed on the base plate 26*b*. The emitted light amount of the light source portion 26*a* of the charge-removing light source 26 is adjustable. In the embodiment, a light-emitting diode (LED) is used for the light source portion 26*a* of the charge-removing light source 26. Instead of an LED, the light source portion 26*a* may be of any light source portion, such as an electro luminescence (EL), that can emit a sufficient light amount that removes a charge from the photoconductor surface 10*a*. As illustrated in FIG. 1, the charge-removing light source 26 is disposed at a side of the back face Pb of the recording medium P conveyed through the downstream conveyance path 9B, to irradiate the photoconductor surface 10*a* with the charge-removing light K passing through the recording medium P. The charge-removing light source 26 is disposed such that the optical axis passes the rotational center of the photoconductor 10 so that the charge-removing light K is emitted to the rotational center of the photoconductor 10. The reference code B3 indicates the irradiation target at which the photoconductor surface 10*a* is irradiated with the charge-removing light K.

Figure 4:
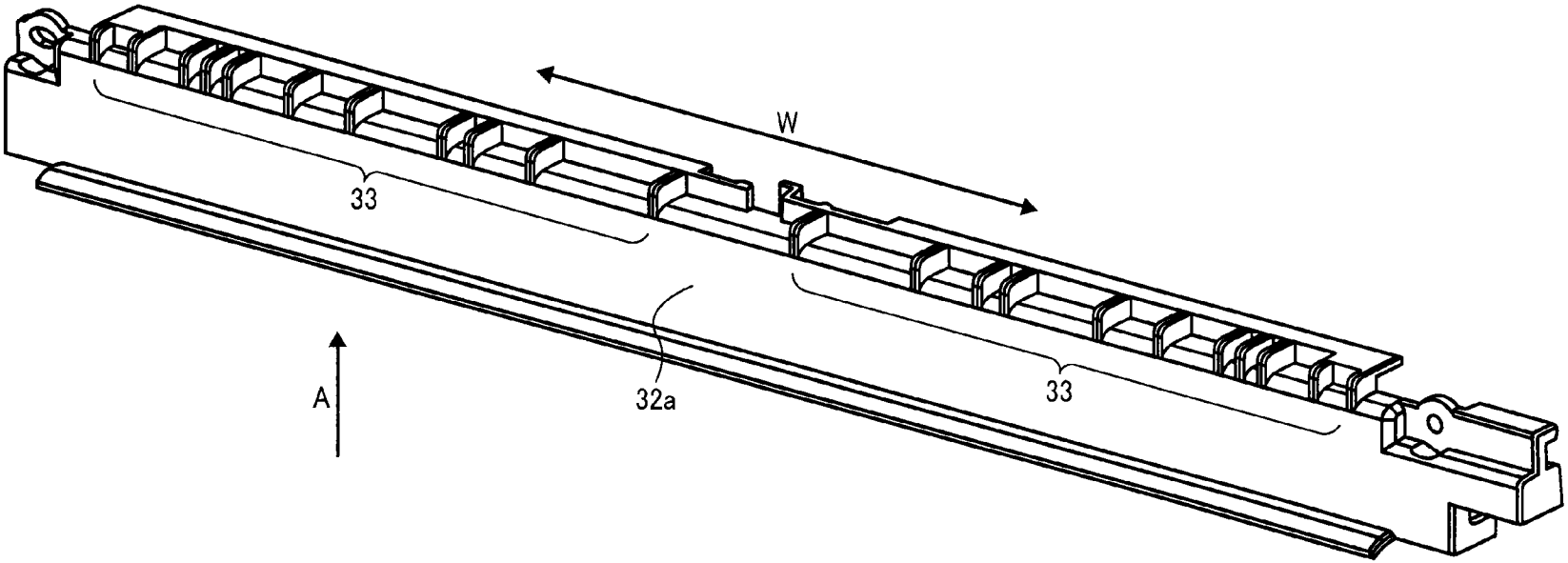
FIG. 4 is a perspective view illustrating a light transmissive member provided with a light irradiator.

As illustrated in FIG. 2, a downstream guide (hereinafter referred to as a guide) 32 having light permeability is disposed between the charge-removing light source 26 and the photoconductor 10. The guide 32 serves as a conveyance guide for guiding the recording medium P conveyed through the downstream conveyance path 9B toward the fixing device 7 (see FIG. 1) as well as a cover for covering the charge-removing light source 26. The guide 32 is made of transparent resin and is disposed between the light source portion 26*a* of the charge-removing light source 26 and the photoconductor 10 to cover at least the light source portion 26*a* and to guide the conveyed recording medium P. In the embodiment, as illustrated in FIGS. 3 and 4, a plurality of charge-removing light sources 26 are linearly arranged with a space therebetween along the lateral direction of the recording medium P as indicated by arrow W. The lateral direction W intersects the recording-medium conveyance direction A at right angles in FIG. 3. In the embodiment, eight light source portions 26*a* are arranged on the base plate 26*b* to constitute the charge-removing light source 26. Instead of providing a plurality of light source portions 26*a* on a single base plate 26*b*, a single light source portion 26*a* may be provided on a single base plate 26*b* to constitute the charge-removing light source 26, and a plurality of charge-removing light sources 26 each having a single light source portion 26*a* may be arranged along the lateral direction W.

The arrangement of the charge-removing light sources 26 are adjusted such that end portions of irradiation areas of charge-removing light K emitted from adjacent light source portions 26*a* overlap each other to give approximately uniform light intensity throughout an irradiation range indicated by W1. The irradiation range W1 on the photoconductor 10 irradiated with the charge-removing light K is wider than at least the lateral length W2 of the recording medium P. In the embodiment, the area on the photoconductor surface 10*a* on which an image may be formed (effective image area) is irradiated with the charge-removing light K emitted from the charge-removing light source 26 before cleaning, which reduces the residual potential of the photoconductor surface 10*a* after the transfer.

The charge-removing light source 26 is disposed between a conveyance guide face 32*a* of the guide 32 and a frame 34 of an openable cover with the light source portion 26*a* disposed at the side of the conveyance guide face 32*a*. The openable cover used for providing access to the conveyance path when, for example, removing a jammed paper, is positioned in the right side of the conveyance path 9B running from the paired registration rollers 19 to the fixing device 7 in FIG. 1. The guide 32 is positioned by the frame 34 abutting the openable cover. Although the whole body of the guide 32 is transparent in the embodiment, the guide 32 may have light permeability in at least the conveyance guide face 32*a* facing the light source portion 26*a*. Transparent resin is used to allow the emitted charge-removing light K to pass through the conveyance guide face 32*a* to reach the photoconductor surface 10*a*. The light permeability required of the guide 32 is not necessarily be provided by transparency of material. Any material that allows light to pass therethrough with a sufficient light amount that can reduce a charge may be used. For example, a translucent material, a colored material, such as a red material, or an obscure material having fine asperity formed by, for example, sand blasting may be used. As illustrated in FIG. 2, an irradiation target B3 at which the photoconductor surface 10*a* is irradiated with the charge-removing light K is determined between the transfer nip N, which is a transfer position, and the cleaning position B2. Irradiation with the charge-removing light K at the irradiation target B3 removes a charge to reduce the residual potential of the photoconductor surface 10*a*. Thus, the charge provided by a charging roller 11 after cleaning by the cleaning blade 15 becomes uniform, which prevents occurrence of a residual image. A charge can be removed efficiently by emitting the charge-removing light K toward the rotational center of the photoconductor 10. Even when the arrangement disallows the charge-removing light K to be emitted toward the rotational center of the photoconductor 10, a sufficient charge-removing effect can still be obtained when a range of pitch angle of approximately ±10 degrees is provided.

As illustrated in FIG. 2, a charge removing needle 30 serving as a charge remover is provided between the transfer roller 14 and the guide 32, more particularly, between the transfer nip N and the charge-removing light source 26. A plurality of metal needles 30*b* are linearly arranged along the lateral direction W on the grounded base 30*a* to constitute the charge removing needle 30 as illustrated in FIG. 3. The tip of the needle 30*b* points the downstream conveyance path 9B and makes contact with the recording medium P that has passed through the transfer nip N to remove a charge from the recording medium P.

In the embodiment, the contact between the recording medium P and the photoconductor surface 10*a* at the transfer nip N may cause paper dust on the recording medium P to adhere to the photoconductor surface 10*a* to become the adhering substance X1. In particular, if a filler such as calcium carbonate, kaolin, and white carbon is included in the recording medium P, such a filler may become a major component of paper dust. A material that potentially becomes paper dust tends to be charged positively and therefore electrostatically adheres to the photoconductor surface 10*a* with a strong force compared to untransferred toner remaining on the photoconductor surface 10*a*. In addition, the paper dust, which has particle sizes smaller than toner, is likely to slip through the cleaning position B2 at which the photoconductor surface 10*a* and the cleaning blade 15 are in contact with each other. By irradiation with the charge-removing light K from the charge-removing light source 26 at the irradiation target B3 in the upstream of the cleaning blade 15 in the photoconductor rotating direction B, the surface potential of the photoconductor 10 is reduced and thereby the electrostatic adhesion force between the photoconductor surface 10*a* and the adhering substance X1 (paper dust) decreases. As a result, the adhering substance X1 can properly be removed from the photoconductor surface 10*a* and collected by the cleaning blade 15. Thus, a preferable duplication with no longitudinal streak can be obtained.

The above described effect can still sufficiently be obtained by irradiating the photoconductor surface 10*a*, which is the photoconductive layer of the photoconductor 10, before cleaned by the cleaning blade 15, with the charge-removing light K having a certain intensity (emitted light amount) that reduces a surface potential of the photoconductor 10 to some degree, if not to approximately zero. Therefore, by irradiating the photoconductor surface 10*a* with a light amount resulting from the light emitted from the charge-removing light source 26, which is disposed at the side of the back face Pb of the recording medium P passing through the recording medium P, the electrostatic adhesion force between the photoconductor surface 10*a* and the adhering substance X1 can be reduced. As a result, the adhering substance X1 slipping through the cleaning position B2 at which the cleaning blade 15 performs cleaning can be prevented.

Generally, when a charge of toner is small, for example, under a high-temperature and high-humidity, a minute amount of toner may be scattered inside a copier 1. Although the charged amount of the scattered toner is smaller than the usual toner, the charge often causes the scattered toner to adhere to the light source portion 26*a* of the charge-removing light source 26. In the embodiment, however, the light transmissive guide 32 disposed between the photoconductor 10 and the charge-removing light source 26 reduces or eliminates the chances of the scattered toner adhering to the light source portion 26*a*. The material of the guide 32 may be glass, in place of resin, but is required to have transparency allowing the light to pass through with a light amount necessary to remove a charge from the photoconductor 10. As illustrated in FIG. 2, the guide 32 also serves as a conveyance guide for guiding the recording medium P from the transfer nip N (transfer position) to the fixing device 7. Since the amount of the scattered toner is minute, concentrated adhesion of the scattered toner to the transparent guide 32 that causes blocking of the charge-removing light K which increases with time to disadvantageously discourages the effect of removing a charge does not occur. In addition, since the recording medium P makes contact with the conveyance guide face 32*a* of the guide 32, the effect of cleaning the scattered toner by the recording medium P making contact with the conveyance guide face 32*a* can also be obtained. With the arrangement in which the charge-removing light source 26 is disposed away from the downstream conveyance path 9B at the side of the back face Pb of the recording medium P, where relatively large space can be secured and a sufficient amount of light emitted from the charge-removing light source 26 is secured, the device need not be made large in size.

The charge-removing light source 26 covered by a light transmissive member may be provided in the same side as the photoconductor 10 (the side of the front face Pa of the recording medium P). However, to arrange two members, that is, the charge-removing light source 26 and the light transmissive member, an arrangement space around the photoconductor 10 (at the side of the front face Pa of the recording medium P) is required, which increases the size of the device (printer). Moreover, a larger amount of toner is scattered onto the surface of the light transmissive member disposed near the photoconductor 10 (disposed at the side of the front face Pa of the recording medium P) than the light transmissive member disposed at the side of the back face Pb of the recording medium P. Therefore, adhesion of scattered toner might block the charge-removing light K from reaching the charge-removing light source 26. As in the embodiment, however, the charge-removing light source 26 is disposed at the side of the back face Pb of the recording medium P, using the space at the side of the back face Pb of the recording medium P in the downstream conveyance path 9B faces more effectively than when the charge-removing light source 26 is disposed at the side of the front face Pa of the recording medium. This arrangement eliminates the need of the device (copier 1) be made large in size. Furthermore, scattering of toner from the photoconductor 10 during the passage of the recording medium P can be blocked by the recording medium P, and the guide 32, which is the light transmissive member, is disposed relatively far from the photoconductor surface 10*a*. Therefore, the amount of scattered toner adhering to the conveyance guide face 32*a*, which is the surface of the guide 32, can be reduced, so that the emitted light amount from the charge-removing light source 26 can preferably be secured with ease. Consequently, adhesion of scattered toner to the charge-removing light source 26 is minimized and thus the device need not be made large in size, and at the same time, a sufficient light amount emitted from the charge-removing light source 26 is secured.

In the embodiment, the conveyance guide face 32*a* has a flat surface at least in the region opposing the light source portion 26*a* of the charge-removing light source 26. The flat surface prevents diffusion of the charge-removing light K. In the embodiment as illustrated in FIG. 4, the conveyance guide face 32*a* is formed flat throughout the lateral direction W, and a plurality of ribs 33 are provided adjacent to the conveyance guide face 32*a* in the recording-medium conveyance direction A to be arranged along the lateral direction W. With this structure, the reduction in light amount of the charge-removing light K from the charge-removing light source 26 caused by dissipation is minimized, and at the same time, the ribs 33 secure the performance of conveying the recording medium P. Of course, the ribs 33 may be provided on the conveyance guide face 32*a* to be arranged along the lateral direction W to improve the performance of conveying the recording medium P. It is preferable in this configuration that the rib 33 is not provided in the region opposing the light source portion 26*a*, so that the performance of conveying the recording medium P and the reduction in light amount of the charge-removing light K from the charge-removing light source 26 caused by dissipation can be minimized.

Figure 5:
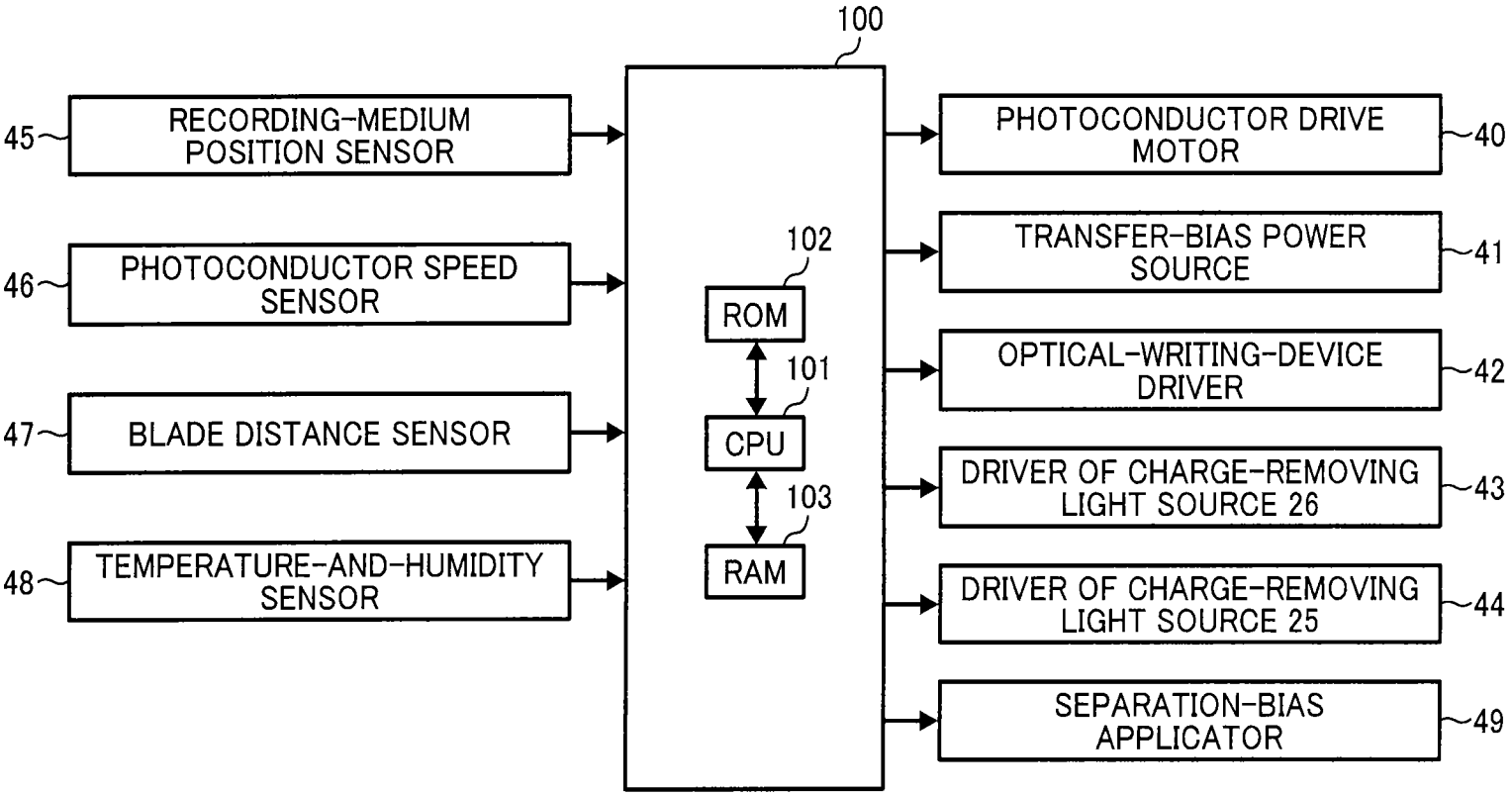
FIG. 5 is a block diagram illustrating a control system of the image forming apparatus illustrated in FIG. 1.

Control of a light-emission timing of the charge-removing light source 26 will now be described. FIG. 5 is a block diagram illustrating the schematic arrangement of the control system of the copier 1. The copier 1 includes a controller 100. The controller 100 includes a central processing unit (CPU) 101 serving as a processor, a read only memory (ROM) 102 serving as a non-volatile memory, and a random access memory (RAM) 103 serving as a temporary storage memory. The controller 100 is connected to devices and sensors via signal lines in a communicating manner to totally control the copier 1. In FIG. 5, only the devices related to a distinguishing feature of the embodiment are illustrated. FIG. 5 illustrates devices and sensors used in embodiments, namely, those function as the controller 100 in each embodiment.

A recording-medium position sensor 45 serving as a recording-medium position detector, a photoconductor speed sensor 46 serving as a rotation speed detector, a blade distance sensor 47 serving as a usage rate detector, and a temperature-and-humidity sensor 48 serving as an environmental condition detector are connected to the input of the controller 100 via signal lines. A drive motor 40 for the photoconductor 10, a transfer-bias power source 41, a driver 42 for an optical writing device 12, a driver 43 for the charge-removing light source 26, a driver 44 for a charge-removing light source 25, and a separation-bias applicator 49 are connected to the output of the controller 100 via signal lines.

The recording-medium position sensor 45 detects the position of the recording medium P that is printed. For example, the recording-medium position sensor 45 may be a passage sensor that is disposed near paired registration rollers 19 and outputs an on-signal when detecting the recording medium P. The photoconductor speed sensor 46 detects the rotation speed of the photoconductor 10 and outputs information on the rotation speed. The blade distance sensor 47 detects the usage rate (used time) of the cleaning blade 15. The blade distance sensor 47 detects a parameter correlated to the usage rate, for example, the number of rotations of the photoconductor 10 or the number of passed sheets, and calculates the distance that the cleaning blade 15 has traveled on the photoconductor surface 10*a* with the rotation of the photoconductor 10. For example, the ROM 102 stores a table that specifies the travel distance by kilometers that is made by 1000 rotations of the photoconductor 10 and is calculated from the circumferential length of the photoconductor 10 obtained by its diameter. For example, it may be determined that the photoconductor 10 makes one rotation by one passage of the recording medium P. The number of passages of the recording mediums P may be counted by, for example, a counter. The temperature-and-humidity sensor 48 detects the temperature and humidity inside the copier 1, which are environmental conditions. The temperature-and-humidity sensor 48 may detect the temperature and humidity in the room where the copier 1 is placed. That is, the temperature-and-humidity sensor 48 detects the temperature and humidity inside and outside the device. The controller 100 controls on and off of the driver 43 for the charge-removing light source 26 according to information detected by each sensor to control the timing of emitting (emission timing of) the charge-removing light K from the charge-removing light source 26. The controller 100 controls the drive motor 40 for the photoconductor 10 to control the rotation speed (linear velocity) of the photoconductor 10. The controller 100 controls the transfer-bias power source 41 to control the output and the output timing of a transfer bias. The controller 100 controls the driver 42 for the optical writing device 12 to control the timing of emitting a writing light and also determines when to start printing according to an on-signal from the driver 42.

Second Embodiment

Figure 6:
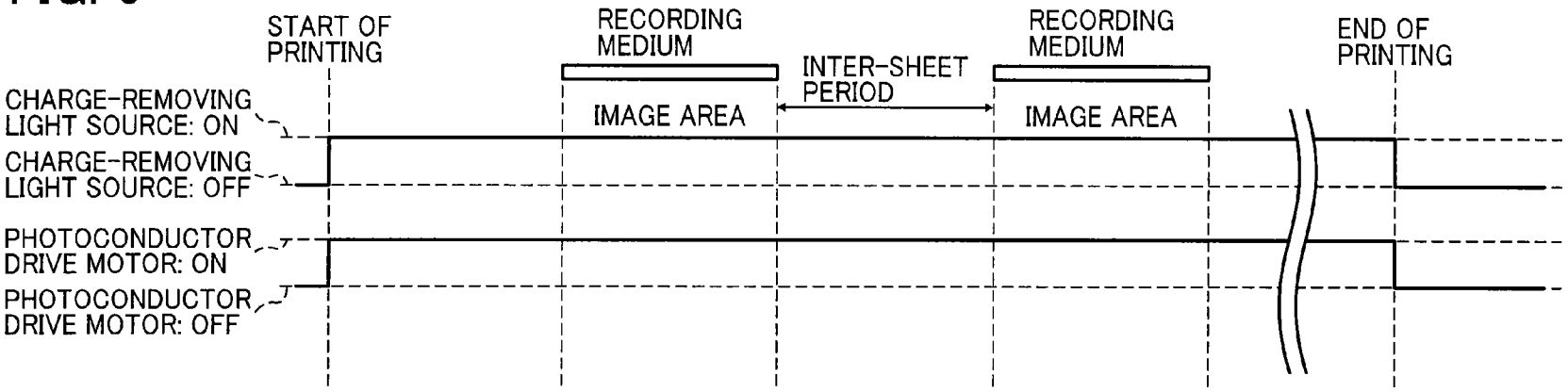
FIG. 6 is a timing chart illustrating a light-emission timing of a light irradiator controlled by a controller according to a second embodiment of the present disclosure.

In a second embodiment, a controller 100 illustrated in FIG. 5 controls a light-emission timing of a charge-removing light source 26. FIG. 6 illustrates a timing chart according to the second embodiment in which the light emission of the charge-removing light source 26 is turned on and off in synchronization with the actuating timing of a drive motor 40 for a photoconductor 10. In the embodiment, by actuating the drive motor 40, the controller 100 performs on-control on a driver 43 of the charge-removing light source 26 for the photoconductor 10 to emit a charge-removing light K from a light source portion 26*a* toward a photoconductor surface 10*a*. In the embodiment, by de-actuating the drive motor 40, the controller 100 performs off-control on the driver 43 to stop emitting the charge-removing light K from the light source portion 26*a*. In this control, the charge-removing light source 26 is turned on only during a period when the photoconductor 10 is rotating, so that the degree of optical fatigue of the photoconductor 10 is low compared to the control in which the charge-removing light K is emitted also during a period when the photoconductor 10 is not rotating. Since the optical fatigue progresses with time, irradiating the photoconductor surface 10*a* with the charge-removing light K during a period in which the photoconductor 10 is not rotating accelerates degradation of a photoconductive layer of the photoconductor 10. However, the light-emission timing control as described in the embodiment improves the durability of the photoconductor 10, and at the same time, a sufficient amount of light emitted from the charge-removing light source 26 is secured.

Third Embodiment

In the second embodiment, the adhesion force between the adhering substance X1 (paper dust) and the photoconductor 10 is reduced by removing charge from the photoconductor surface 10*a* using the charge-removing light K passing through the recording medium P. In an inter-sheet period in which the recording medium P does not exist between the photoconductor 10 and the charge-removing light source 26, however, the amount of adhering substance X1 on the photoconductor 10 tends to be smaller than when the transfer nip N is catching the recording medium P. In a third embodiment illustrated in FIG. 7, a controller 100 controls a light-emission timing of a charge-removing light source 26 to synchronize with a timing of applying a transfer bias to a transfer roller 14. That is, a light source portion 26*a* of the charge-removing light source 26 emits a charge-removing light K in synchronization with a transfer bias, which is a transfer output at a transfer nip N, which is a transfer position (see FIG. 1). In the inter-sheet period, light emission of the light source portion 26*a* of the charge-removing light source 26 is turned off to minimize optical fatigue of the photoconductor 10. The controller 100 locates a conveyed recording medium P according to whether a recording-medium position sensor 45 is giving an output (on-signal). That is, while the recording-medium position sensor 45 detects the recording medium P and outputs a detection signal (on-signal), the controller 100 illustrated in FIG. 5 performs on-control on a driver 43 of the charge-removing light source 26 to emit light from the light source portion 26*a* of the charge-removing light source 26. When the recording-medium position sensor 45 gives no detection signal, the controller 100 performs off-control on the driver 43 to stop the emission of the charge-removing light K from the light source portion 26*a* of the charge-removing light source 26.

Figure 7:
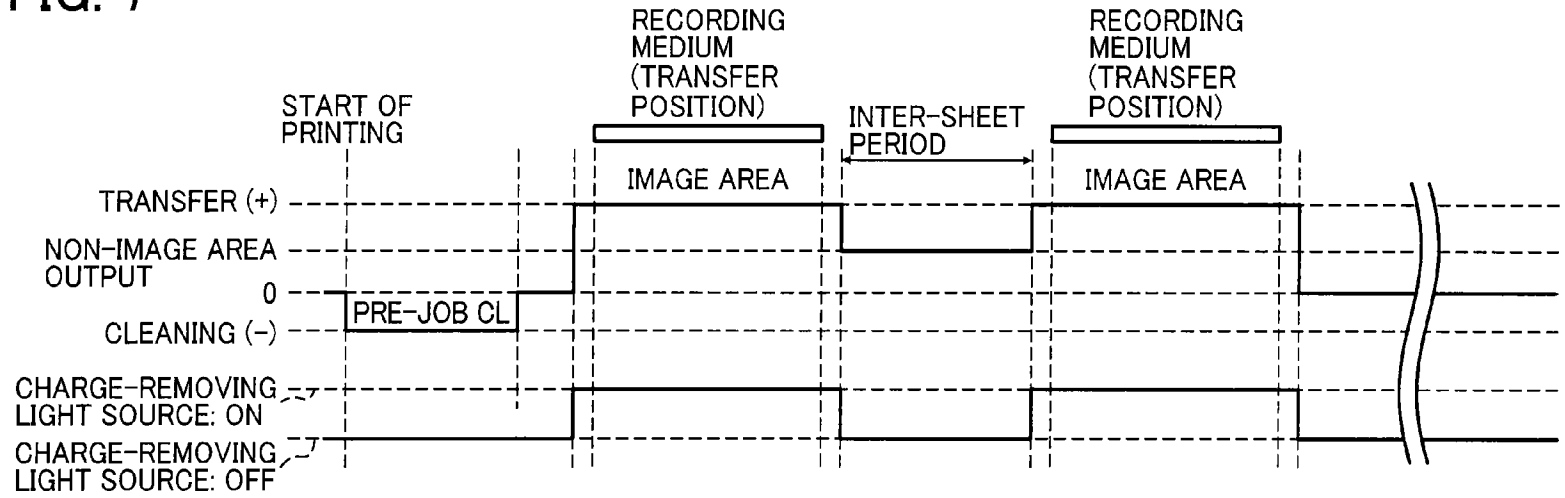
FIG. 7 is a timing chart illustrating a light-emission timing of a light irradiator controlled by a controller according to a third embodiment of the present disclosure.

As illustrated in FIG. 2, the transfer nip N and an irradiation target B3 for the charge-removing light K are shifted from each other along a photoconductor rotating direction B. In the embodiment as illustrated in FIG. 7, the controller 100 starts on-control on a transfer-bias power source 41 at a timing shortly before the recording medium P reaches the transfer nip N and starts off-control on the transfer-bias power source 41 after the recording medium P has come out of the transfer nip N. Therefore, the charge-removing light K is emitted onto the photoconductor surface 10*a* through the recording medium P while the period in which the recording medium P is conveyed through a downstream conveyance path 9B. Thus, the optical fatigue of the photoconductor 10 can further be minimized than the second embodiment.

Fourth Embodiment

In a fourth embodiment, the control on the output of a charge-removing light source 26 (emitted-light-amount control) is performed by a controller 100 to obtain higher efficiency and a further preferable effect. The amount of an adhering substance X1 on a photoconductor 10 tends to be larger at a position at which a recording medium P is interposed in a transfer nip N. Meanwhile, since the adhering substance X1 (paper dust) on a transfer roller 14 moves to the photoconductor 10 in an inter-sheet period, the adhering substance X1 is mixed into recycled toner through a developing device 13 and may be developed together with toner. So that a small amount of adhering substance X1 on the photoconductor 10 is observed in the inter-sheet period. Since an emitted charge-removing light K reaches a photoconductor surface 10*a* after passing through the recording medium P, the light amount (irradiation amount) on the photoconductor 10 differs between a sheet-passing period and the inter-sheet period.

Figure 8:
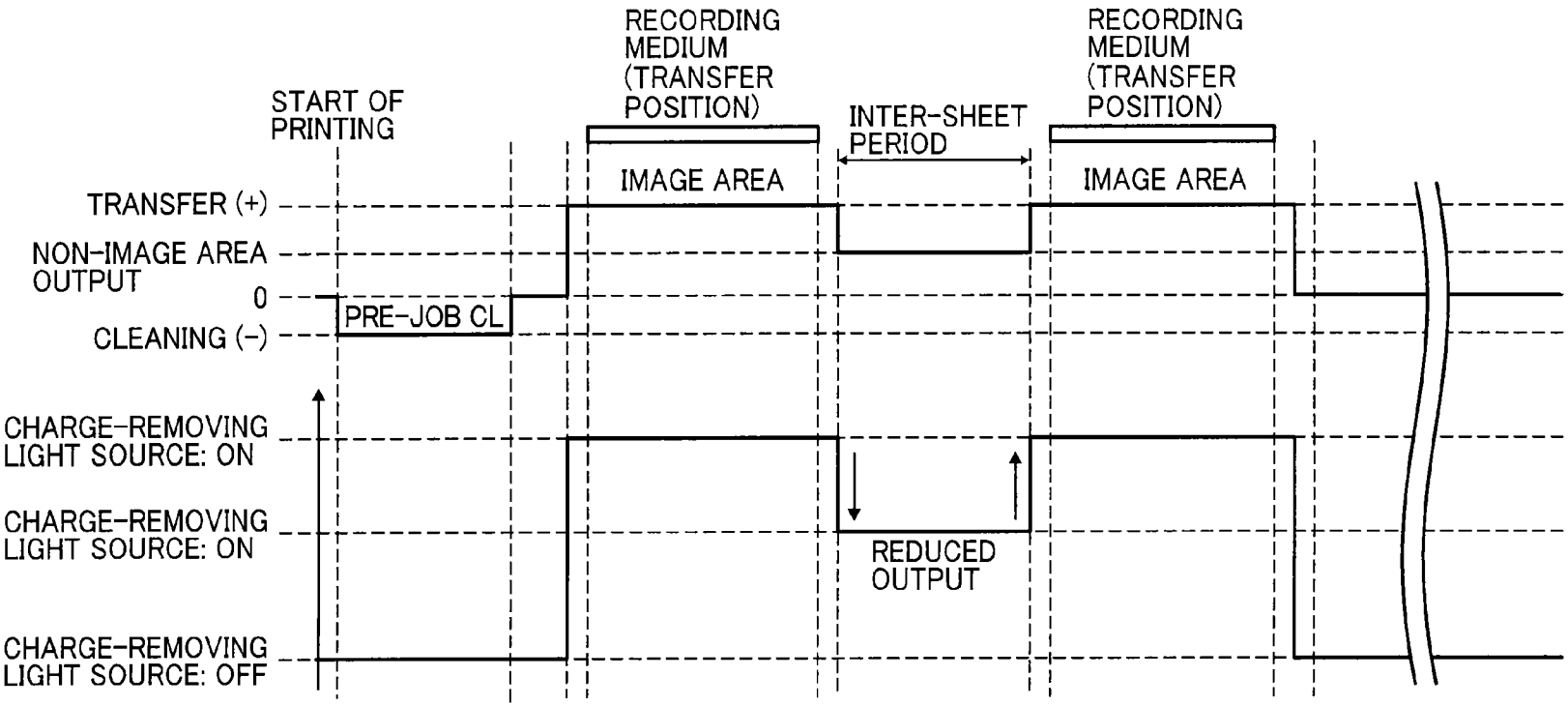
FIG. 8 is a timing chart illustrating a light-emission timing of a light irradiator controlled by a controller according to a fourth embodiment of the present disclosure.

In the embodiment as illustrated in FIG. 8, the controller 100 controls the emitted light amount of a light source portion 26*a* of the charge-removing light source 26. Specifically, the controller 100 controls the emitted light amount of the light source portion 26*a* of the charge-removing light source 26 according to the timing of conveying the recording medium P. The controller 100 controls the charge-removing light source 26 to emit a large light amount in the sheet-passing period in which the recording medium P is being conveyed through the downstream conveyance path 9B and to emit a small light amount in the inter-sheet period in which the recording medium P is not being conveyed through the downstream conveyance path 9B. The controller 100 distinguishes the sheet-passing period and the inter-sheet period of the recording medium P according to whether a recording-medium position sensor 45 is giving an on-signal. That is, in the embodiment, the controller 100 suitably controls the light-emission timing and the light amount of the charge-removing light source 26 to give a large emitted light amount in the sheet-passing period in which the transfer nip N is catching the recording medium P and to reduce the emitted light amount in the inter-sheet period in which the transfer nip N is not catching the recording medium P to give a small irradiation-light amount (reduce output). The irradiation-light amount under the reduced output is still sufficient to reduce the electrostatic adhesion force between the adhering substance X1 (paper dust) and the photoconductor 10. In this manner, the optical fatigue of the photoconductor 10 can be minimized and also the adhering substance X1 (paper dust) slipping through a cleaning blade 15 at a cleaning position B2 (see FIG. 2) can be prevented. The image quality can thus be maintained.

Fifth Embodiment

Figure 9:
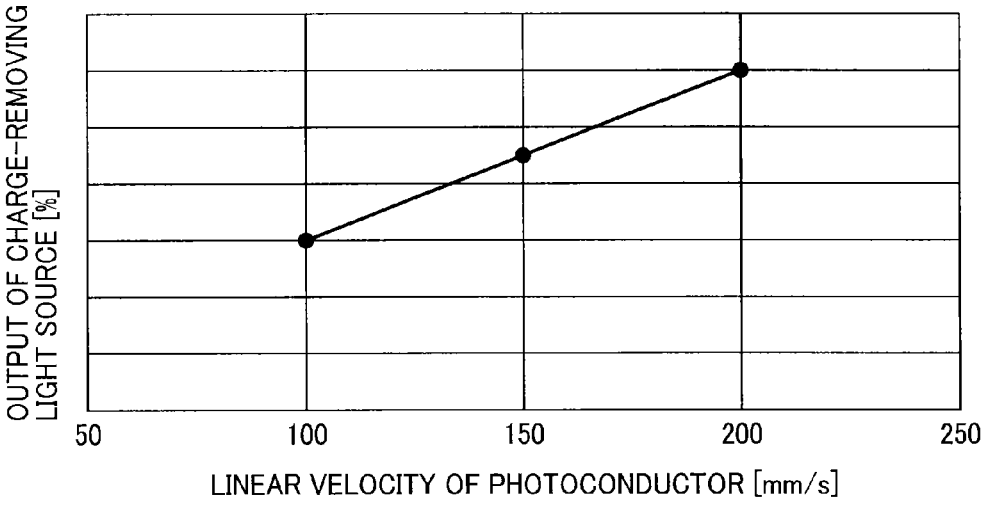
FIG. 9 illustrates a characteristic of output control of a light irradiator by a controller according to a fifth embodiment of the present disclosure.

In a fifth embodiment, the light amount of a charge-removing light K from a charge-removing light source 26 is adjusted by a controller 100 according to the rotation speed (linear velocity) of a photoconductor 10. The irradiation-light amount on the photoconductor 10 to reduce the electrostatic adhesion force between an adhering substance X1 (paper dust) and the photoconductor 10 changes with the linear velocity, or the rotation speed, of the photoconductor 10. As the linear velocity of the photoconductor 10 rises (increases), the irradiation time per unit length decreases, so that for a higher linear velocity, the amount of the charge-removing light K emitted from the charge-removing light source 26 has to be raised (increased). A copier 1 according to the embodiment operates under modes, such as a low speed mode, in which the photoconductor 10 rotates at a smaller linear velocity, to perform a noiseless operation or to obtain a high quality image, than the normal mode, and a mode in which the linear velocity is adjusted according to the type of sheet. The controller 100 adjusts the light amount (output) of the charge-removing light source 26 according to the linear velocity as illustrated in FIG. 9 to adjust the balance between the optical fatigue of the photoconductor 10 and the performance of cleaning the adhering substance X1.

A ROM 102 of the controller 100 illustrated in FIG. 5 previously stores a data table specifying the relationship between the linear velocity of the photoconductor 10 detected by a photoconductor speed sensor 46 and the output of the charge-removing light K emitted from the charge-removing light source 26. The data table specifies that the irradiation amount, or an output, of the charge-removing light source 26 increases with the increase in the linear velocity of the photoconductor 10 increases. That is, the output percentage (%) of a light source portion 26*a* of the charge-removing light source 26 increases as the linear velocity of the photoconductor 10 increases, where the maximum output is 100%. The output (irradiation-light amount) of the charge-removing light source 26 corresponding to the linear velocity is capable of sufficiently reducing the electrostatic adhesion force of the adhering substance X1 (paper dust) on a photoconductor surface 10*a* rotating at the linear velocity. The controller 100 controls the charge-removing light source 26 to give a large emitted light amount (irradiation-light amount) when the rotation speed detected by the photoconductor speed sensor 46 is large and to give a small emitted light amount (irradiation-light amount) when the rotation speed is small. Even under the change in the linear velocity of the photoconductor 10, the light amount of the charge-removing light K corresponding to the linear velocity is emitted onto the photoconductor surface 10*a*. Therefore, the adhesion force of the adhering substance X1 (paper dust) can sufficiently be reduced to prevent the adhering substance X1 from slipping through a cleaning position B2 (see FIG. 2). Thus, the image quality can be maintained.

Sixth Embodiment

Figure 10:
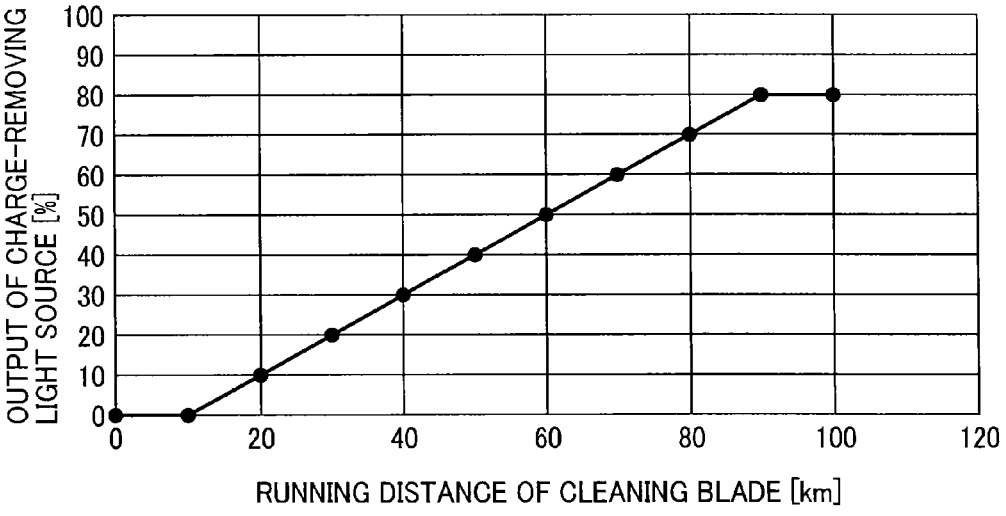
FIG. 10 illustrates a characteristic of output control of a light irradiator by a controller according to a sixth embodiment of the present disclosure.

In a sixth embodiment, the light amount of a charge-removing light K from a charge-removing light source 26 is adjusted by a controller 100 according to the usage rate of a cleaning blade 15. In the embodiment, it is likely that a urethane rubber blade used for the cleaning blade 15 wears by sliding against a photoconductor surface 10*a* to degrade its cleaning performance with time, resulting in poor cleaning performance than an initial cleaning performance. In the embodiment as illustrated in FIG. 10, the controller 100 adjusts the light amount, or an output, of the charge-removing light source 26 according to the usage rate (running distance in FIG. 10) of the cleaning blade 15. A ROM 102 of the controller 100 illustrated in FIG. 5 previously stores a data table specifying the relationship between the running distance, which is the usage rate of the cleaning blade 15, detected by a blade distance sensor 47 and the output of the charge-removing light K emitted from the charge-removing light source 26. The data table specifies that the irradiation-light amount, or the output, increases with the increase in the used distance of the cleaning blade 15. The irradiation-light amount increases by increasing the emitted light amount of a light source portion 26*a* of the charge-removing light source 26. The output percentage (%) of the light source portion 26*a* of the charge-removing light source 26 increases as the used distance (running distance) of the cleaning blade 15 increases, where the maximum output is 100%. The output (irradiation-light amount) of the charge-removing light source 26 corresponding to a used distance of the cleaning blade 15 is capable of sufficiently reducing the electrostatic adhesion force of an adhering substance X1 (paper dust) on a photoconductor surface 10*a* to clean off the adhering substance X1 with the cleaning blade 15 that has reached the used distance. In the embodiment, the controller 100 controls the charge-removing light source 26 to increase the emitted light amount with the increase in the usage rate detected by the blade distance sensor 47. Therefore, the adhering substance X1 slipping through a cleaning position B2 at which the cleaning blade 15 is in contact with the photoconductor surface 10*a* (see FIG. 2) can still be prevented even after a time has elapsed. Thus, the image quality can be maintained.

Seventh Embodiment

Figure 11:
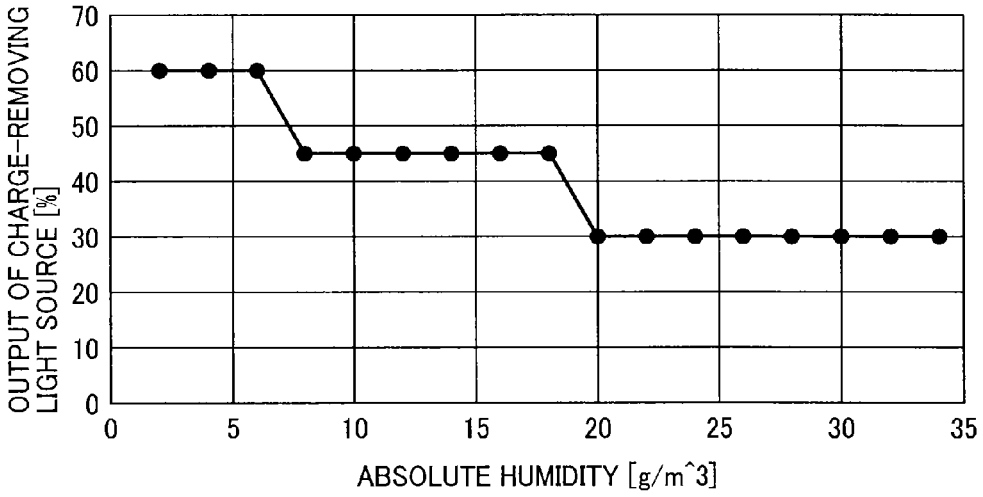
FIG. 11 illustrates a characteristic of output control of a light irradiator by a controller according to a seventh embodiment of the present disclosure.

In a seventh embodiment, the output of a charge-removing light K from the charge-removing light source 26 is adjusted by a controller 100 according to the information on temperature and humidity which are environmental conditions of a copier 1. As described above, adhering substances, in particular, an adhering substance X1 which is paper dust, is often slightly charged positively, and the amount of charge may change with the change in temperature and humidity. The charged amount generally tends to be higher under a lower humidity, which may cause the adhering substance X1 to slip through a cleaning position B2 (see FIG. 2) at which a cleaning blade 15 is in contact with a photoconductor surface 10*a*. In the embodiment, a temperature-and-humidity sensor 48 (see FIG. 5) is provided as an environmental condition detector and the controller 100 adjusts the emitted light amount of a light source portion 26*a* of a charge-removing light source 26 according to the value detected by the temperature-and-humidity sensor 48 as illustrated in FIG. 11. In the embodiment, an absolute humidity is obtained from the value detected by the temperature-and-humidity sensor 48, and the light amount is adjusted according to the absolute humidity.

A ROM 102 of the controller 100 illustrated in FIG. 5 previously stores a data table specifying the relationship between the absolute humidity obtained from the information on temperature and humidity, which are environmental conditions, detected by the temperature-and-humidity sensor 48 and the output of the charge-removing light K from the charge-removing light source 26. The data table specifies that the irradiation-light amount, or an output, of the charge-removing light source 26 decreases stepwise with the increase in the absolute humidity. The percentage (%) of the output of the light source portion 26*a* of the charge-removing light source 26 decreases stepwise with the increase in the absolute humidity, where the maximum output is 100%. The output (irradiation-light amount) of the charge-removing light source 26 corresponding to an absolute humidity is capable of sufficiently reducing the electrostatic adhesion force of the adhering substance X1 (paper dust) on a photoconductor surface 10*a* under the absolute humidity.

In the embodiment, the controller 100 controls the emitted light amount of the charge-removing light source 26 according to the detection result of the temperature-and-humidity sensor 48. Specifically, the emitted light amount of the charge-removing light source 26 is controlled to reduce the emitted light amount stepwise with the increase in the absolute humidity obtained from the value detected by the temperature-and-humidity sensor 48. Therefore, even under the change in the environmental condition of a copier 1, the controller 100 controls, according to the change, the output (irradiation-light amount) of the charge-removing light K emitted from the charge-removing light source 26 onto the photoconductor surface 10*a* to increase or decrease. As a result, the adhering substance X1 (paper dust) slipping through the cleaning position B2 at which the cleaning blade 15 is in contact with the photoconductor surface 10*a* is prevented even under the change in the environmental condition. Thus, the image quality can be maintained.

Eighth Embodiment

Figure 13:
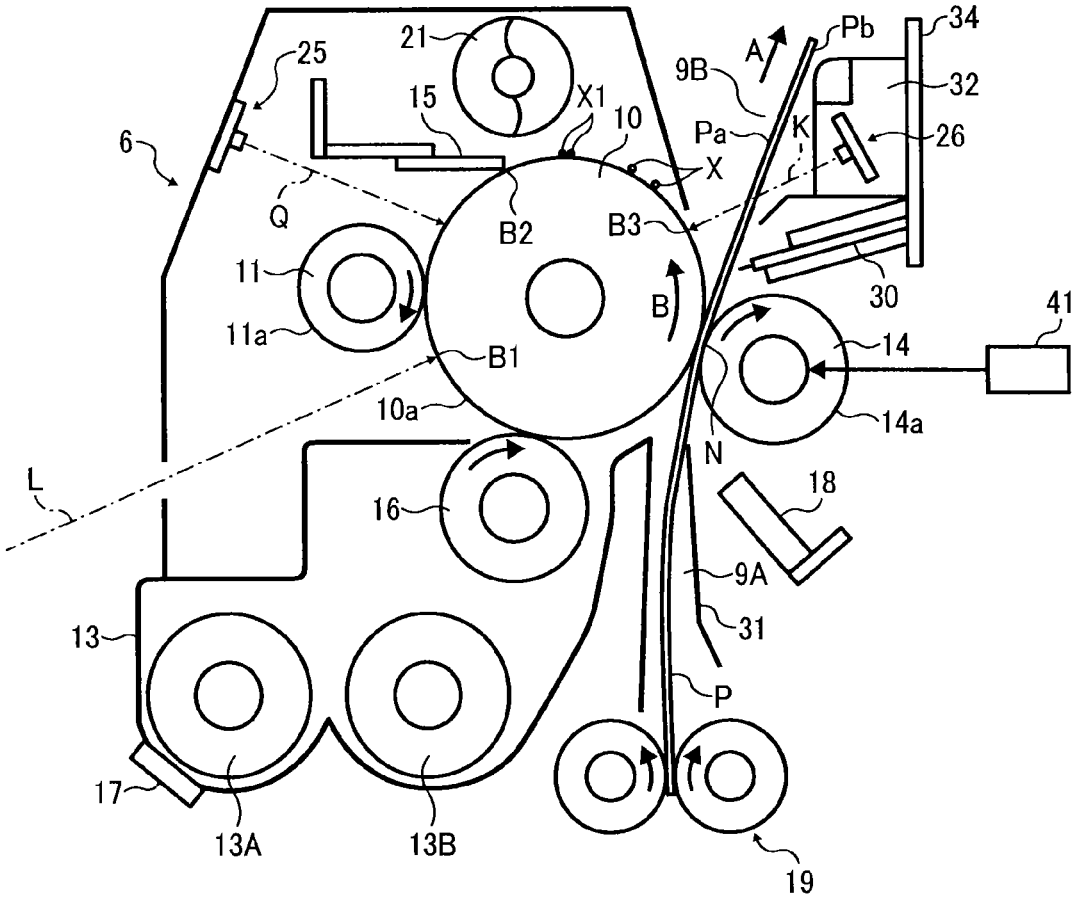
FIG. 13 is an enlarged view illustrating an essential portion according to an eighth embodiment of the present disclosure.

In the first to seventh embodiments, as illustrated in FIG. 2, the charge-removing light source 26 is used to irradiate the photoconductor surface 10*a* disposed with the charge-removing light K, targeted between the transfer nip N and the cleaning position B2, at which the cleaning blade 15 performs cleaning. The cost of this configuration is low because the irradiation target B3 is the only irradiation target. Although the configuration illustrated in FIG. 2 has no disadvantage in a normal operation, uneven surface potential of the photoconductor 10 before being charged by the charging roller 11 may cause a residual image. It is desirable to remove a charge after the cleaning by the cleaning blade 15 to obtain further higher image quality. In an eighth embodiment as illustrated in FIG. 13, a charge-removing light source 25 serving as a charge removing device that emits a charge-removing light Q onto a photoconductor surface 10*a* is provided between a cleaning blade 15 and a charging roller 11 in addition to a charge-removing light source 26. As illustrated in FIG. 5, a driver 44 for a charge-removing light source 25 is connected to the output of a controller 100 via a signal line. The controller 100 controls on and off of the charge-removing light source 25. In this configuration, the charge-removing light Q is emitted onto the photoconductor surface 10*a* which has been removed of a charge by the charge-removing light source 26 and cleaned by the cleaning blade 15. Regarding light-emission timings of the charge-removing light source 25 and the charge-removing light source 26, for example, the controller 100 actuates a driver 43 for the charge-removing light source 26 and the driver 44 for the charge-removing light source 25 (see FIG. 6) to irradiate the photoconductor surface 10*a* with a charge-removing light K and the charge-removing light Q while a drive motor 40 for a photoconductor 10 is running.

The embodiment includes the charge-removing light source 25 disposed between the cleaning blade 15 and a charging roller 11 to emit the charge-removing light Q onto the photoconductor surface 10*a*, targeted between the cleaning blade 15 and the charging roller 11, to constitute a charge removing device for removing a residual charge from the photoconductor surface 10*a*. With this configuration, a charge can be removed from the photoconductor surface 10*a* uniformly under the condition with no adhering substance X, such as untransferred toner and aggregated toner remaining after cleaning by the cleaning blade 15, and an adhering substance X1. In this manner, the surface potential of the photoconductor 10 can be adjusted to be uniform after removing a charge by the charging roller 11. Thus, the image quality can further be improved.

Figure 12:
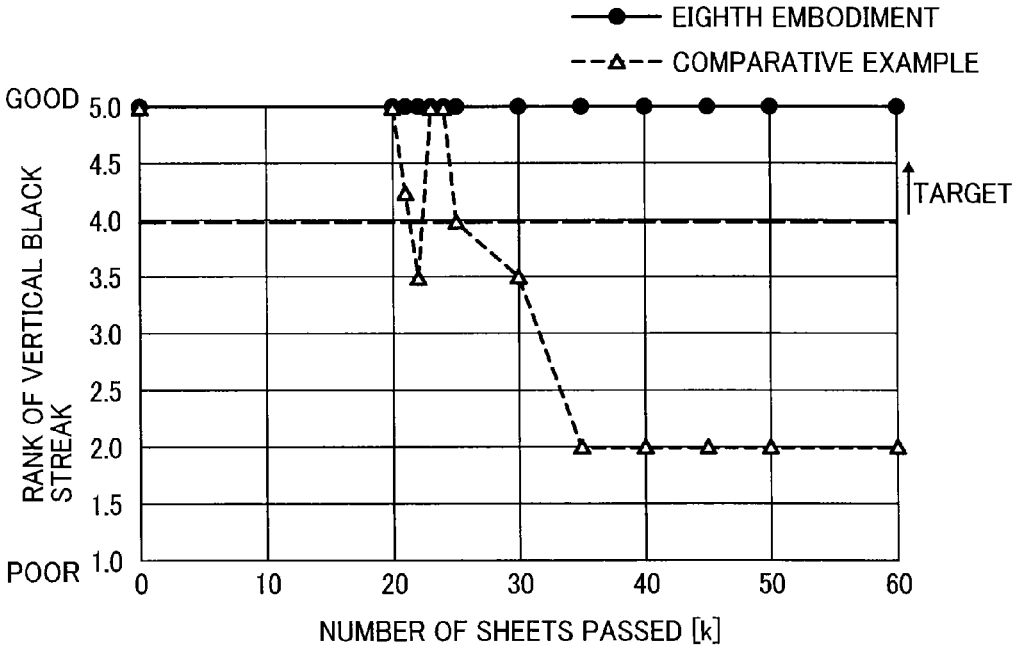
FIG. 12 illustrates a change in a degree of black streaks occurred on a recording medium.
Figure 14:
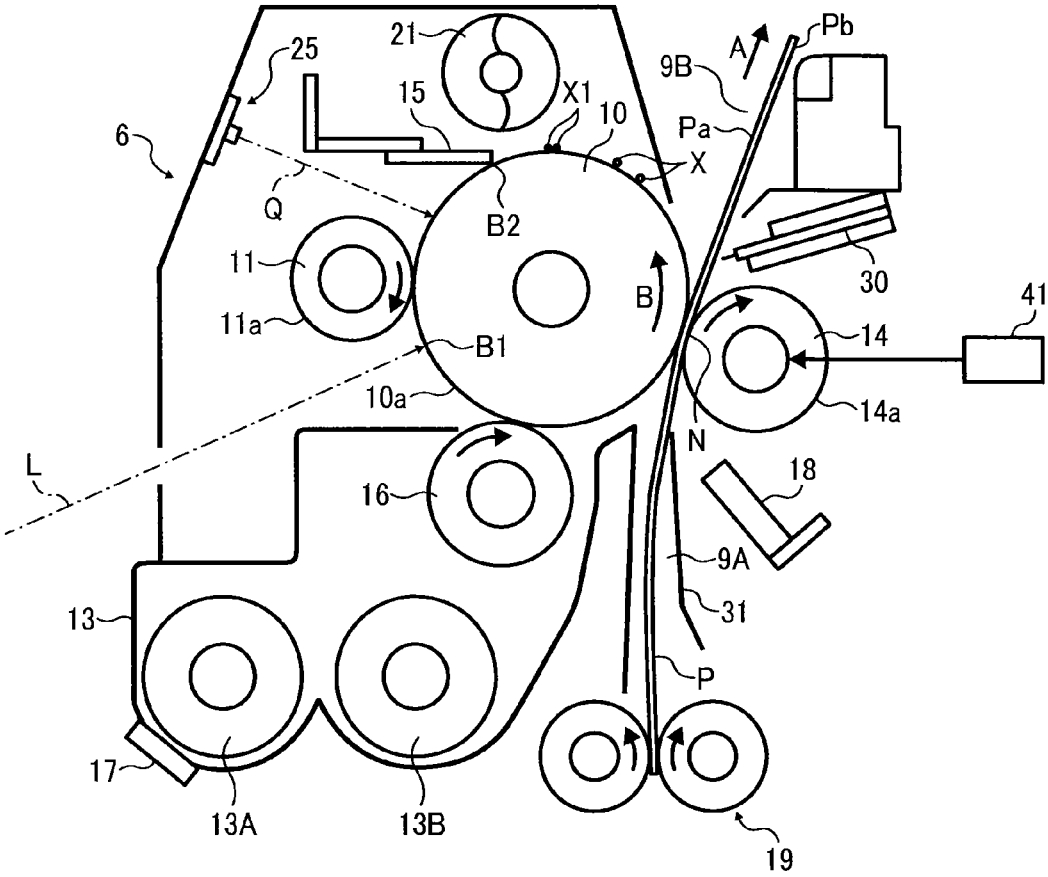
FIG. 14 is an enlarged view illustrating an arrangement of a comparative embodiment.

The degree of occurrence of black streaks was examined for the eight embodiment illustrated in FIG. 13 and for a comparative embodiment illustrated in FIG. 14 operated with the light-emission timing of the charge-removing light source 26 illustrated in FIG. 6. Results are illustrated in FIG. 12. To determine operating conditions for the tests, of which results are illustrated in FIG. 12, conditions under which the adhering substance X1 (paper dust) easily slips through the cleaning position B2 illustrated in FIGS. 13 and 14 were previously studied, such as a sheet type (e.g., a sheet including a large volume of calcium carbonate) and an image area rate, to determine the condition that causes black streaks with high possibility. FIG. 12 illustrates the result expressed using a unique degree that represents the degree of occurrence of black streaks with the number of images output by an operating copier 1. The degree of 1 indicates the highest degree of occurrence of black streaks and the degree of 5 indicates no occurrence of black streak. The degree of 4 indicates no occurrence of black streak or almost no occurrence of a noticeable black streak, that is, no disadvantage on image quality. The comparative embodiment does not include the charge-removing light source 26 illustrated in FIG. 14 but includes the charge-removing light source 25.

According to the result of the degree in the comparative embodiment (the configuration illustrated in FIG. 14), black streaks gradually increase as the number of passed sheets increases, and the degree worsens with time, with continuous occurrence of black streaks. Meanwhile, in the embodiment illustrated in FIG. 13, the degree of 4, which is a target value, or above is still kept after the number of passed sheets has been counted up according to detection of images. The results show that the occurrence of black streaks is minimized at and after the initial period. By irradiating the photoconductor surface 10*a* not only with the charge-removing light K from the charge-removing light source 26 before the cleaning by the cleaning blade 15 but also with the charge-removing light Q from the charge-removing light source 25 after the cleaning, a device having a black-streak-preventive (black-streak-minimizing) arrangement can be provided. Thus, the image quality can further be improved.

Ninth Embodiment

As illustrated in FIG. 3, paper dust easily moves from the recording medium P to the photoconductor 10 at a leading end Pc and a trailing end Pd of the recording medium P. The leading end Pc is in the leading side in the recording-medium conveyance direction A, and the trailing end Pd is the opposite side to the leading end Pc. At the leading end Pc, the recording medium P hitting the photoconductor 10 is likely to cause paper dust to mechanically move from the recording medium P to the photoconductor 10. At the trailing end Pd, separating discharge generated by separation of the recording medium P from the photoconductor 10 is likely to cause paper dust to electrostatically adhere to the photoconductor 10. In these cases, a large amount of the adhering substance X1 adheres to the photoconductor 10, and a portion of the adhering substance X1 may slip through the cleaning position B2 at which the cleaning blade 15 is in contact with the photoconductor 10. In such a case, the performance of the cleaning blade 15 preventing the adhering substance from slipping through the cleaning blade 15 (at the cleaning position B2) can be improved by intensifying the charge-removing light K from the charge-removing light source 26. Intensifying the charge-removing light K however causes optical fatigue of the photoconductor 10 and might result in deterioration in durability of the photoconductor 10.

Figure 15A:
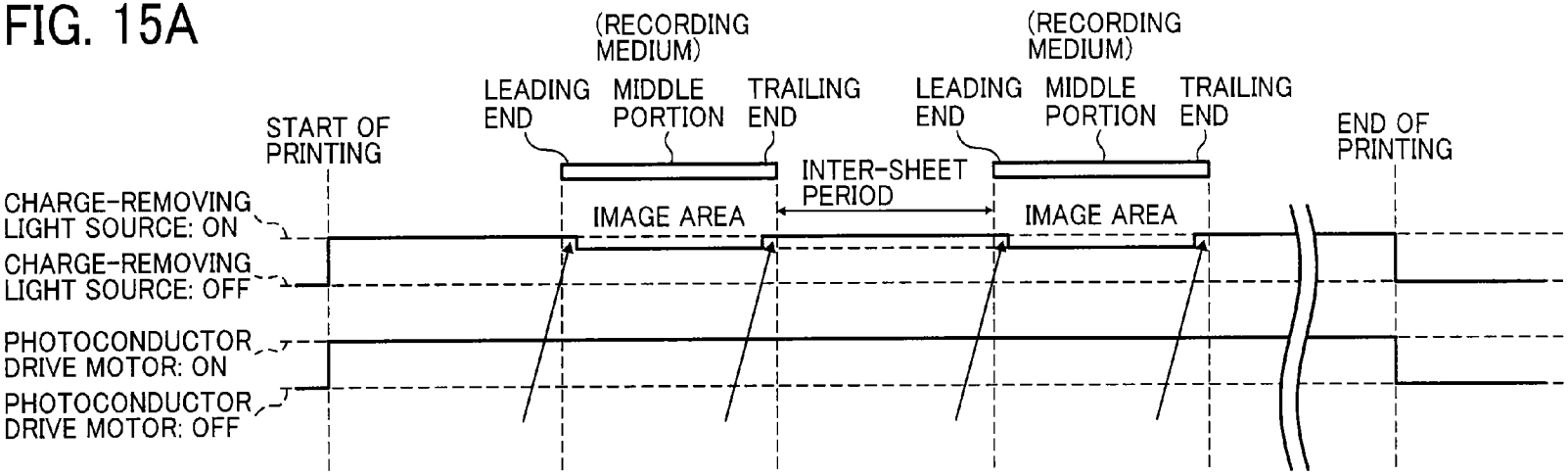
FIGS. 15A to 15C illustrate characteristics of output control of a light irradiator by a controller according to a ninth embodiment of the present disclosure.
Figure 15B:
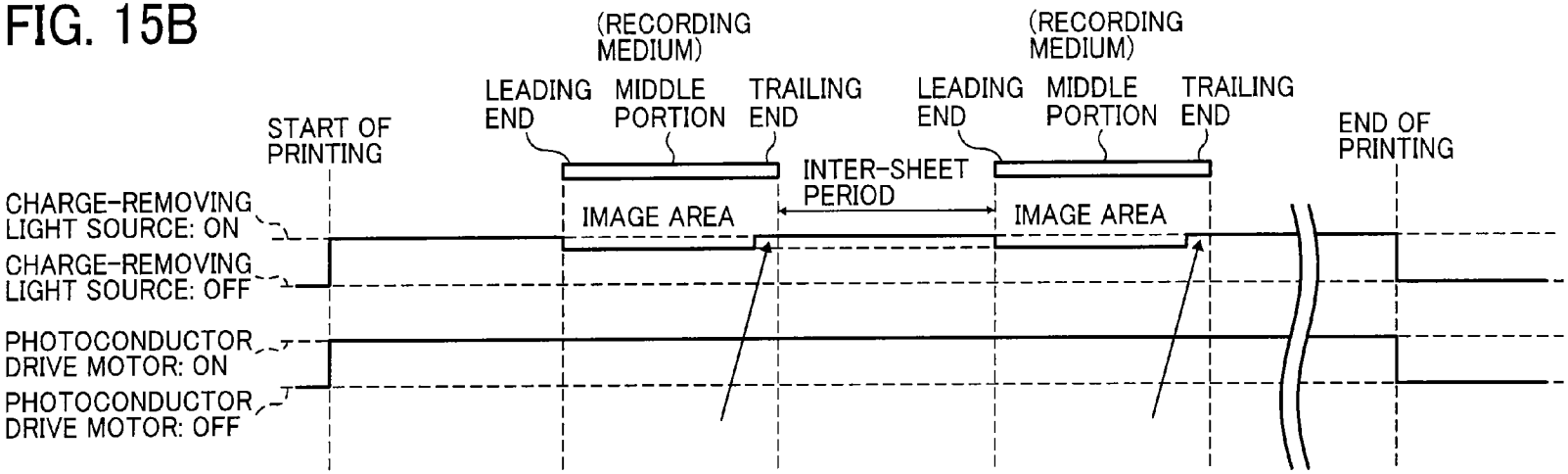
Figure 15C:
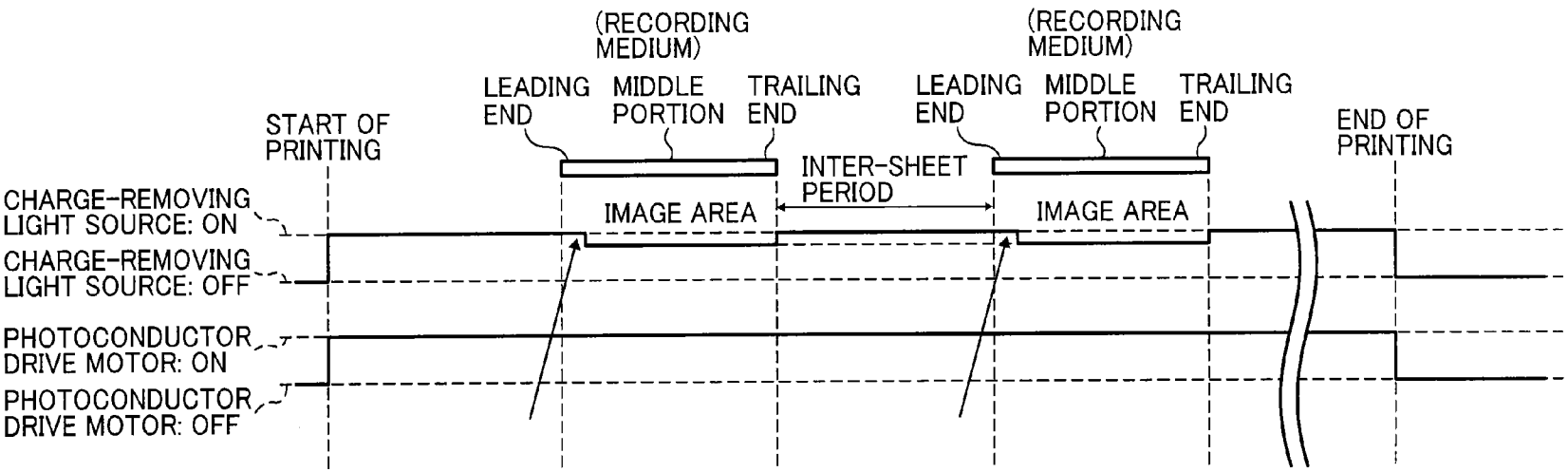

In a ninth embodiment, a charge-removing light K is intensified only in the period in which adhesion of paper dust to the photoconductor 10 is high. In the embodiment as illustrated in FIG. 15, a controller 100 illustrated in FIG. 5 controls a charge-removing light source 26 to emit a larger amount of light to at least one of a leading end Pc and a trailing end Pd than to a middle portion Pe of the recording medium P. Adhesion of paper dust to the photoconductor 10 is high in the period in which light is emitted to the leading end Pc and in the period in which light is emitted to the trailing end Pd. FIG. 15A illustrates a control in which the light amount of the charge-removing light K emitted to each of the leading end Pc and trailing end Pd is larger than the light amount emitted to the middle portion Pe. FIG. 15B illustrates a control in which the light amount of the charge-removing light K emitted to the trailing end Pd is larger than the light amount emitted to the middle portion Pe. FIG. 15C illustrates a control in which the light amount of the charge-removing light K emitted to the leading end Pc is larger than the light amount emitted to the middle portion Pe. As described above, the controller 100 controls the charge-removing light source 26 to emit the charge-removing light K to a photoconductor surface 10*a* with an output (irradiation-light amount) greater than the charge-removing light K emitted to the middle portion Pe in at least one of the period in which the leading end Pc passes a transfer nip N and the period in which the trailing end Pd passes the transfer nip N. This minimizes the optical fatigue of the photoconductor 10 and also prevents an adhering substance X1 (paper dust) from slipping through a cleaning position B2 at which a cleaning blade 15 is in contact with the photoconductor surface 10*a*. Thus, the image quality can be maintained.

Figure 16:
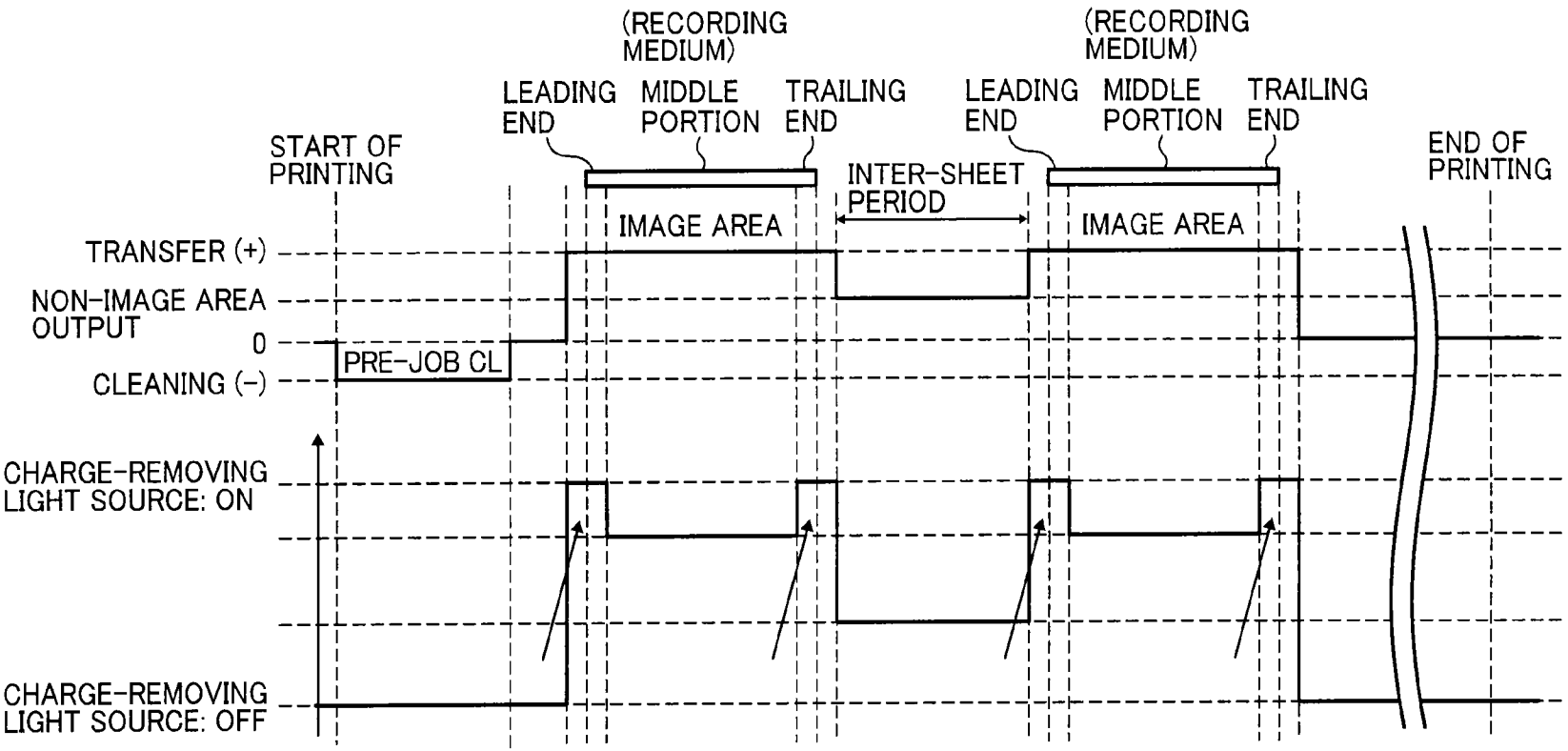
FIG. 16 illustrates a characteristic of another exemplary output control of the light irradiator by the controller according to the ninth embodiment of the present disclosure.

FIG. 16 illustrates a variation embodiment of the ninth embodiment. In the variation embodiment, the controller 100 controls the charge-removing light source 26 to emit the charge-removing light K to the photoconductor surface 10*a* with an output (irradiation-light amount) greater than the charge-removing light K emitted to the middle portion Pe in both the period in which the leading end Pc passes the transfer nip N and the period in which the trailing end Pd passes the transfer nip N. In this case, the control is performed such that the charge-removing light K is output before the leading end Pc of the recording medium P reaches the transfer nip N and an output continues after the trailing end Pd has passed the transfer nip N. Furthermore, as in the fourth embodiment illustrated in FIG. 8, the controller 100 suitably controls the light-emission timing and the light amount of the charge-removing light source 26 to give a large emitted light amount in a sheet-passing period in which the transfer nip N is catching the recording medium P and to reduce the emitted light amount in an inter-sheet period in which the transfer nip N is not catching the recording medium P to give a small irradiation-light amount (reduce output). This configuration minimizes the optical fatigue of the photoconductor 10 and also prevents in a further secured manner the adhering substance X1 (paper dust) from slipping through the cleaning position B2 at which the cleaning blade 15 is in contact with the photoconductor surface 10*a*. Thus, the image quality can be maintained. In addition, the charge-removing light K is output to the leading end Pc of the recording medium P before the leading end Pc reaches the transfer nip N, and the charge-removing light K is output to the trailing end Pd of the recording medium P after the trailing end Pd has passed the transfer nip N. Thus, even under the change in the conveyance speed of the recording medium P, the leading end Pc and the trailing end Pd are surely irradiated with the charge-removing light K with a light amount larger than the light amount emitted to the middle portion Pe. Thus, the optical fatigue of the photoconductor 10 can further be minimized.

Tenth Embodiment

As described above, the light transmissive guide 32 can prevent the charge-removing light source 26 being smeared, but the smear on the guide 32 caused by scattered toner worsens with time and might reduce the amount of the charge-removing light K reaching the photoconductor 10. As already explained with reference to FIGS. 3 and 4, the guide 32 is cleaned by the recording medium P making contacting with the conveyance guide face 32*a* opposing the light source portion 26*a* of the guide 32. Since the cleaning is performed when the amount of adhering toner is still small, the degree of smear on the recording medium P resulting from the cleaning is as small as can hardly be seen, which has no disadvantage in usage. The guide 32 however may fail to make contact with the conveyance guide face 32*a* when a certain type of recording medium P is used, which might degrade the performance of cleaning. Accumulation of toner on the guide 32 causes the recording medium P to be smeared when the behavior of the conveyed recording medium P changes by decrease in the amount of light reaching the photoconductor 10, change of types of the recording medium P, or by a curl resulting from development in duplex printing.

Figure 17:
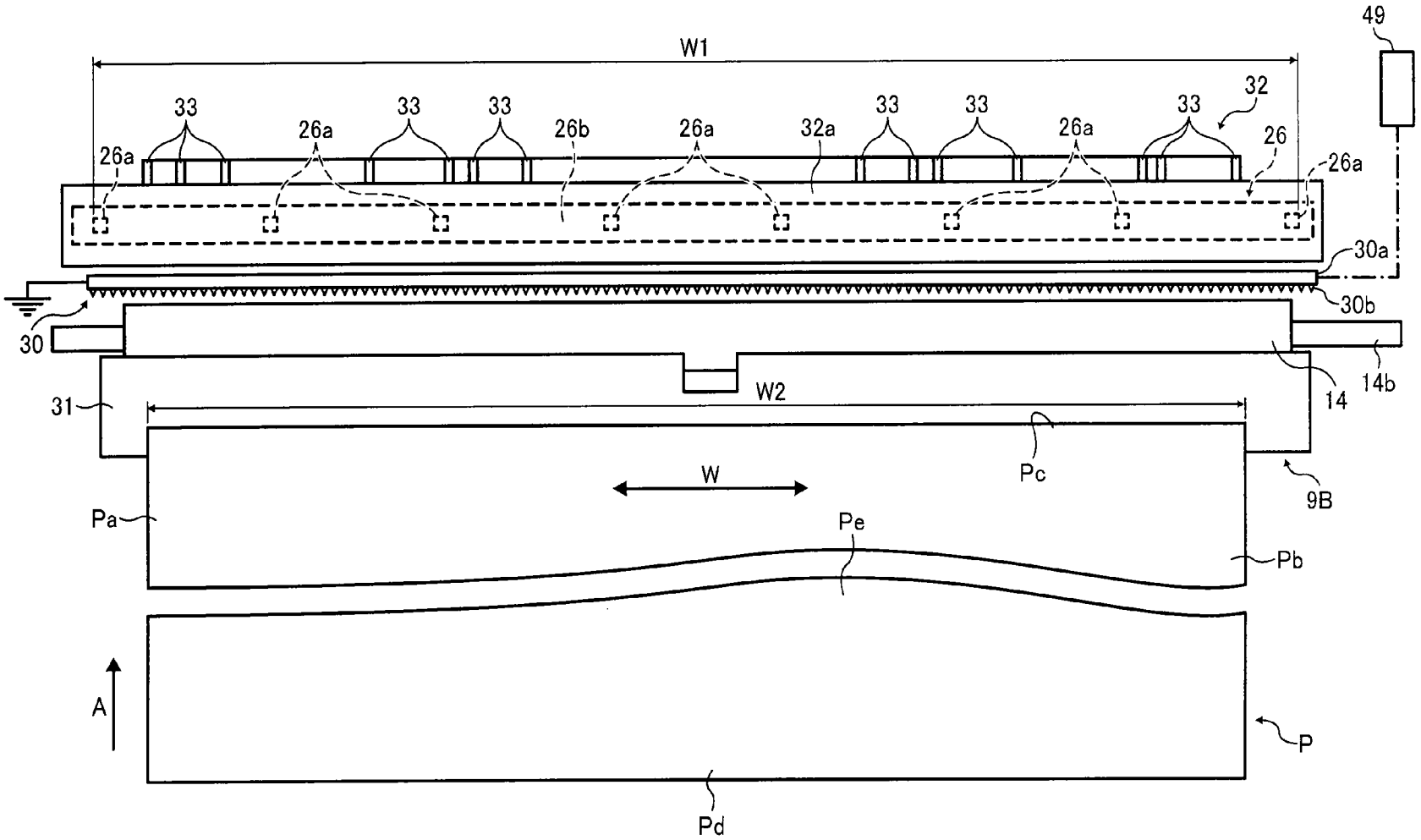
FIG. 17 is a schematic arrangement view illustrating an essential portion according to a tenth embodiment of the present disclosure.
Figure 18A:
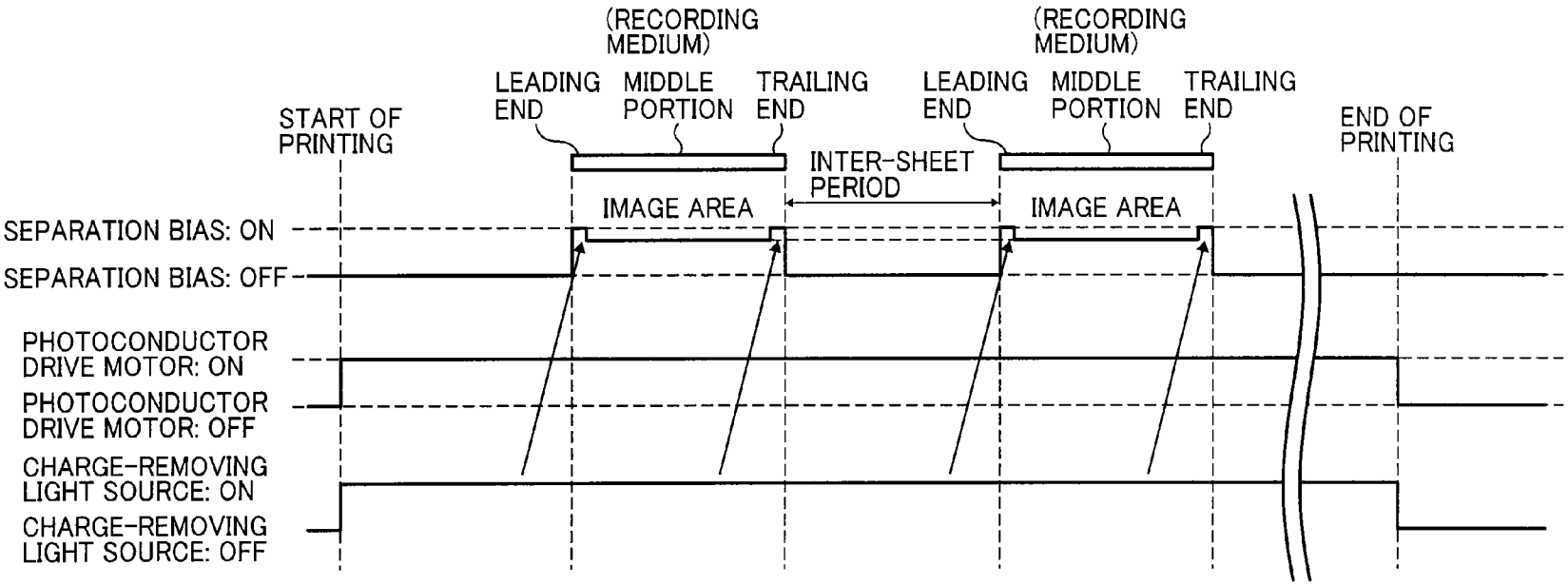
FIGS. 18A to 18C illustrate characteristics of output control of a separation-bias output device by a controller according to the tenth embodiment of the present disclosure.
Figure 18B:
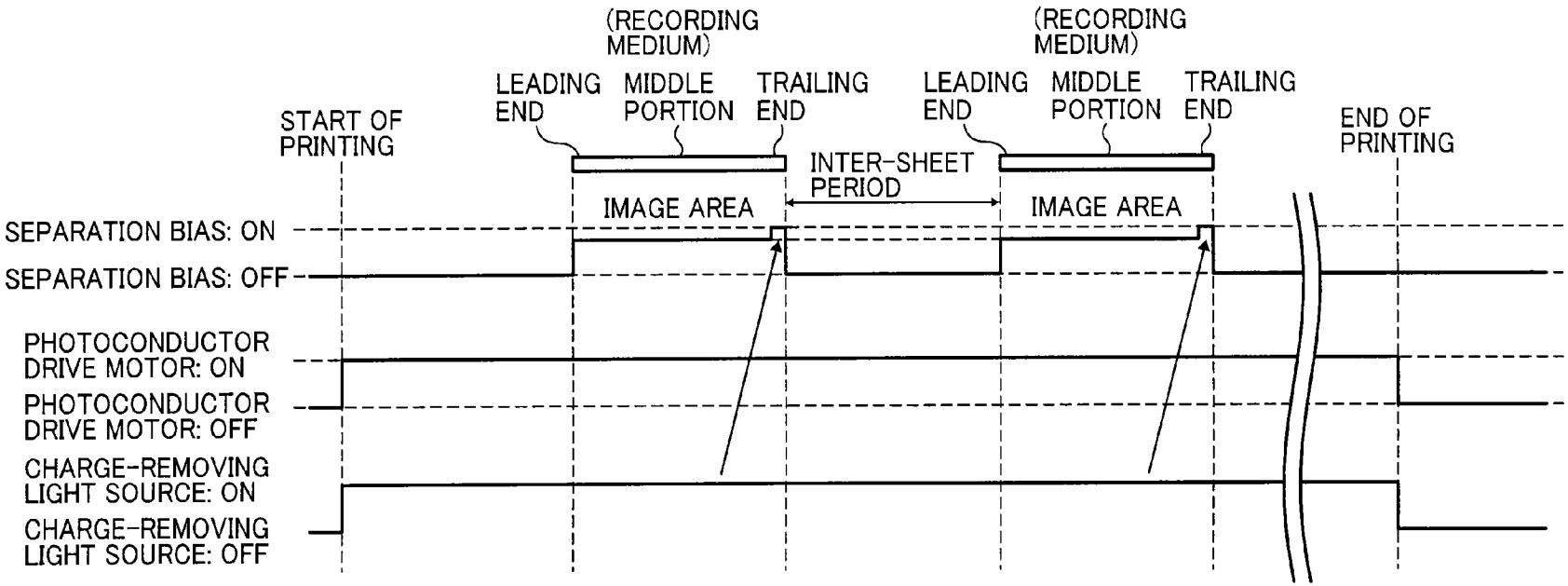
Figure 18C:
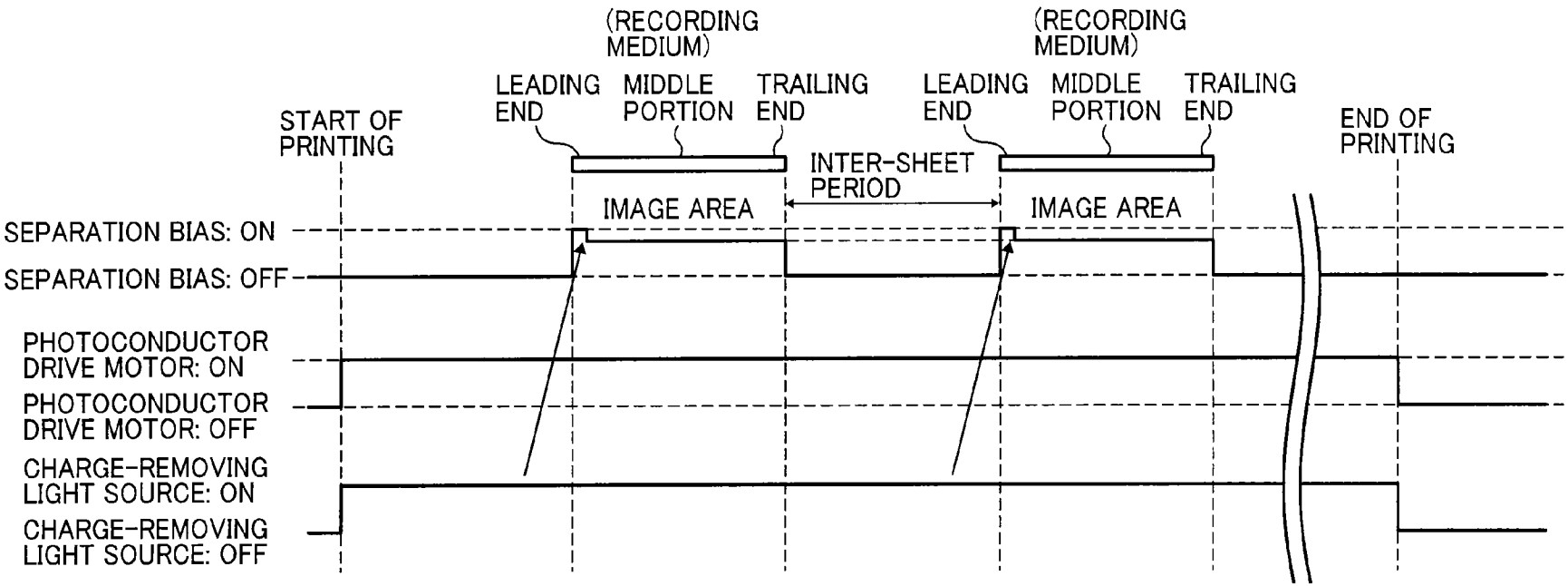

In a tenth embodiment as illustrated in FIG. 17, a separation-bias is applied to a charge removing needle 30 to surely lead a recording medium P toward a guide 32 so that the recording medium P stably comes into contact with a conveyance guide face 32*a* of the guide 32. In this manner, the cleaning by the recording medium P is stably performed to prevent accumulation of toner on the conveyance guide face 32*a* (guide). When a strong separation-bias is applied, a transfer current might leak to the charge removing needle 30 near a transfer nip N, and might cause failure in generating a target transfer electric field at the transfer nip N, resulting in an abnormal image. Therefore, the embodiment includes a separation-bias applicator 49 that can apply a separation-bias to the charge removing needle 30 serving as a charge remover provided in the downstream of a transfer roller 14, serving as a transfer member, in a recording-medium conveyance direction A. As illustrated in FIGS. 18A to 18C, the separation-bias applicator 49 outputs a separation-bias such that at least one of the separation-bias applied to a leading end Pc and the separation-bias applied to a trailing end Pd is higher than the separation-bias applied to a middle portion Pe of the recording medium P. Note that, the leading end Pc and the trailing end Pd are non-image areas. FIG. 18A illustrates a control in which the separation-bias applied to the leading end Pc and the separation-bias applied to the trailing end Pd are higher than the separation-bias applied to the middle portion Pe. FIG. 18B illustrates a control in which the separation-bias applied to the trailing end Pd is higher than the separation-bias applied to the middle portion Pe. FIG. 18C illustrates a control in which the separation-bias applied to the leading end Pc is higher than the separation-bias applied to the middle portion Pe. The separation-bias applicator 49 is a power source connected via a signal line to the output of a controller 100 illustrated in FIG. 5. The controller 100 controls the output of the separation-bias applicator 49.

In the configuration described above, a separation-bias is applied only to at least one of the leading end Pc and the trailing end Pd, which are non-image areas, or alternatively, only the output of a separation-bias of at least one of the leading end Pc and the trailing end Pd is intensified. In this manner, occurrence of an abnormal image can be minimized and also the cleaning performance of the guide 32 can be stabilized. The output of separation-bias need not be raised at both the leading end Pc and trailing end Pd of the recording medium P. A sufficient effect can be obtained by intensifying the output of the separation-bias at either the leading end Pc or the trailing end Pd for a certain type of the recording medium P. Furthermore, applying a separation-bias to the charge removing needle 30 also improves separation of the recording medium P after passing through the transfer nip N, which provides an effect of preventing separating discharge to a photoconductor 10.

Figure 19:
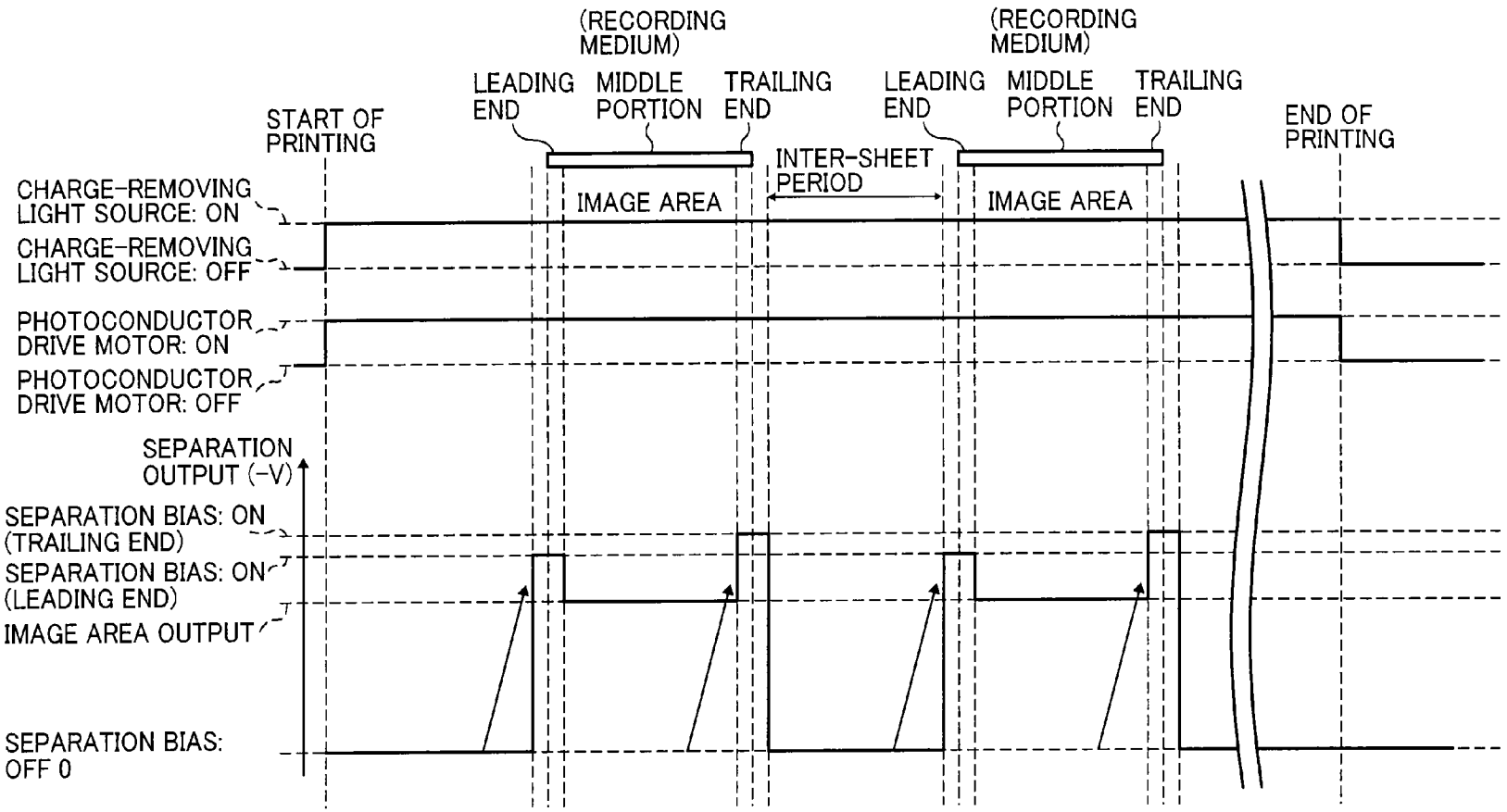
FIG. 19 illustrates a characteristic of another exemplary output control of the separation-bias output device by the controller according to the tenth embodiment.

FIG. 19 is a variation embodiment of the tenth embodiment. In this variation embodiment, a separation-bias higher than the separation-bias applied to the middle portion Pe is output and applied to both the leading end Pc and the trailing end Pd of the recording medium P. The separation-bias applied to the trailing end Pd is higher than the separation-bias applied to the leading end Pc. Furthermore, in the variation embodiment, an output period of separation-bias is controlled to start before the leading end Pc reaches the charge removing needle 30 and to continue after the trailing end Pd has passed through the charge removing needle 30. In this configuration, a separation-bias is applied only to at least one of the leading end Pc and the trailing end Pd, which are non-image areas, or alternatively, only the output of separation-bias of at least one of the leading end Pc and the trailing end Pd is intensified. Thus, the occurrence of an abnormal image is minimized and also the cleaning performance of the guide 32 can be stabilized. Furthermore, applying to the trailing end Pd a separation-bias greater (higher) than the separation-bias applied to the leading end Pc improves separation of the trailing end Pd, which further preferably prevents separating discharge to the photoconductor 10. Moreover, the output of the separation-bias to the leading end Pc starts before the leading end Pc reaches the charge removing needle 30, and the output of the separation-bias to the trailing end Pd continues after the trailing end Pd has passed through the charge removing needle 30. In this manner, a separation-bias can surely be applied to the leading end Pc and the trailing end Pd even under a fluctuating conveyance speed of the recording medium P. Stable separation is thus kept to minimize the occurrence of an abnormal image and to stabilize the cleaning performance of the guide 32.

Figure 20:
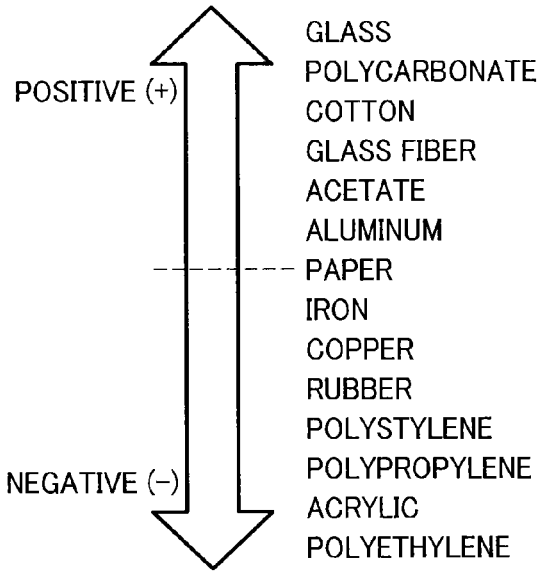
FIG. 20 illustrates an example of triboelectric series of materials used for a guide.

The method of preventing adhesion of toner to the light transmissive guide 32 (smear on the guide 32) is not limited to applying a separation-bias to the charge removing needle 30. For example, adhesion of toner can be prevented by using a material that hardly attracts toner for the guide 32. Toner is usually charged to a desired degree of polarity suitable for development and transfer. The guide 32 is charged by making contact with the recording medium P. The guide 32 charged to have an opposite polarity to toner electrostatically attracts scattered toner and thus becomes smeared. Therefore, a material having a polarity ranked in triboelectric series to the same negative or positive side as the toner from the recording medium P is preferably used for the guide 32. For example, when using negatively charged toner, a material having a polarity ranked in the triboelectric series to the negative side from the recording medium P is selected. By selecting a material having such a polarity, the negatively charged guide 32 electrostatically repulses the toner scattered by the contact between the conveyed recording medium P and the guide 32, thereby preventing the guide 32 from being smeared by adhesion of toner. FIG. 20 illustrates an example of the triboelectric series of materials. In a case when negatively-charged toner is used, for example, use of polypropylene having a polarity ranked in the triboelectric series to the negative side from the recording medium P, which is the same side as the toner, prevents the guide 32 being smeared by adhesion of toner.

The light transmissive guide 32 may have conductivity. The guide 32 having conductivity reduces the electrostatic force between toner and the guide 32, which prevents the guide 32 being smeared by adhesion of toner. For example, use of conductive polymer having a surface resistance of $10^{12}\Omega$ or below as a material of the guide 32 prevents triboelectric charging of the guide 32 during conveyance of the recording medium P and thus prevents the guide 32 being smeared by toner.

Eleventh Embodiment

As described in the first to tenth embodiments, irradiation of the photoconductor surface 10*a* with the charge-removing light K from the charge-removing light source 26 after transfer but before cleaning reduces the adhesion force between the photoconductor surface 10*a* and the adhering substance X1. But if the charge-removing light K leaks from the charge-removing light source 26 to the pre-transfer side, that is, to the upstream of the transfer nip N in the recording-medium conveyance direction A, a charge is removed from the photoconductor surface 10*a* before transfer. Removal of charge causes scattering of toner from the photoconductor surface 10*a* before transfer and may result in a blurred image (image unevenness). The photoconductor surface 10*a* irradiated with the direct charge-removing light K from the charge-removing light source 26 may also be irradiated at the ends thereof with the charge-removing light K that has indirectly reached the photoconductor surface 10*a* by reflection on a member. To prevent such indirect irradiation, a surface 14*a* of the transfer roller 14 is provided to cover the entire lateral length of the photoconductor 10 (including a non-effective bare roller section) to eliminate a gap 52 between the photoconductor surface 10*a*. In the region of the photoconductor 10 other than the portion within an effective axial length (which is charged and cleaned), the ends of the cleaning blade 15 are disposed where the gap 52 might be created. A large amount of toner remains after the cleaning in this region, because toner overflows from the end of the cleaning blade 15. Therefore, all the remaining toner after cleaning is input (guided) onto the transfer roller 14 if the surface 14*a* of the transfer roller 14 exists in this region. In other words, this region, which is outside the lateral length of the recording medium P, is always in contact with the surface 14*a* of the transfer roller 14. Continuous input of toner onto the surface 14*a* of the transfer roller 14 results in failure of cleaning the surface 14*a* of the transfer roller 14 (for example, in a cleaning mode in which a bias is applied to retransfer the toner from the surface 14*a* to the photoconductor 10). As a result, continuous accumulation of toner results in smearing of an end or the back face of the recording medium P. The area of the surface 14*a* of the transfer roller 14 is usually determined with consideration on the maximum lateral length of a passing sheet. The length of the surface 14*a* of the transfer roller 14 is generally equal to or larger, or smaller in some cases, than the total lateral length of the recording medium P, and is preferably set as small as possible. The transfer roller 14 is preferably set as short as possible considering the cost.

Figure 22A:
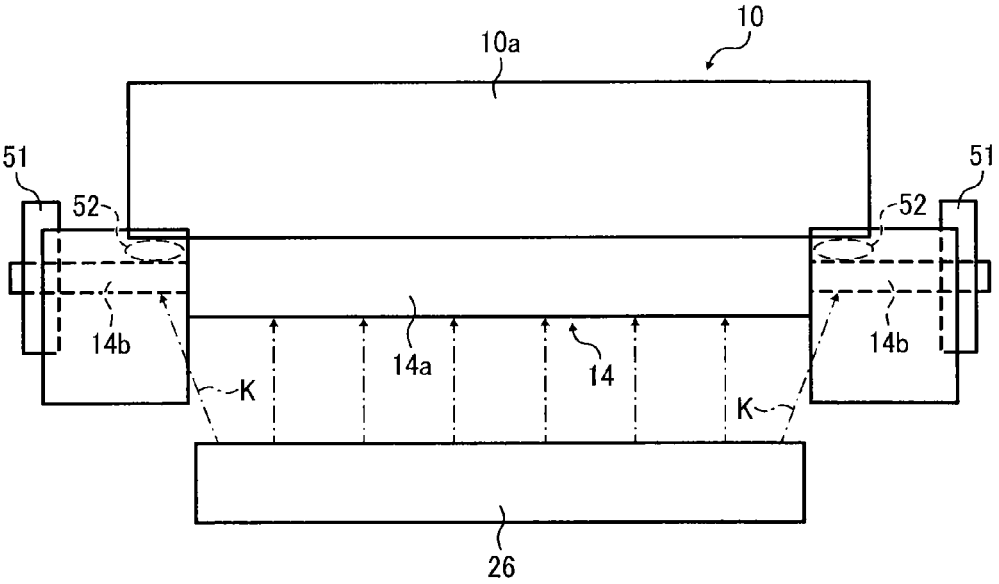
FIG. 22A is an enlarged view of an arrangement of a cover according to the eleventh embodiment of the present disclosure.
Figure 22B:
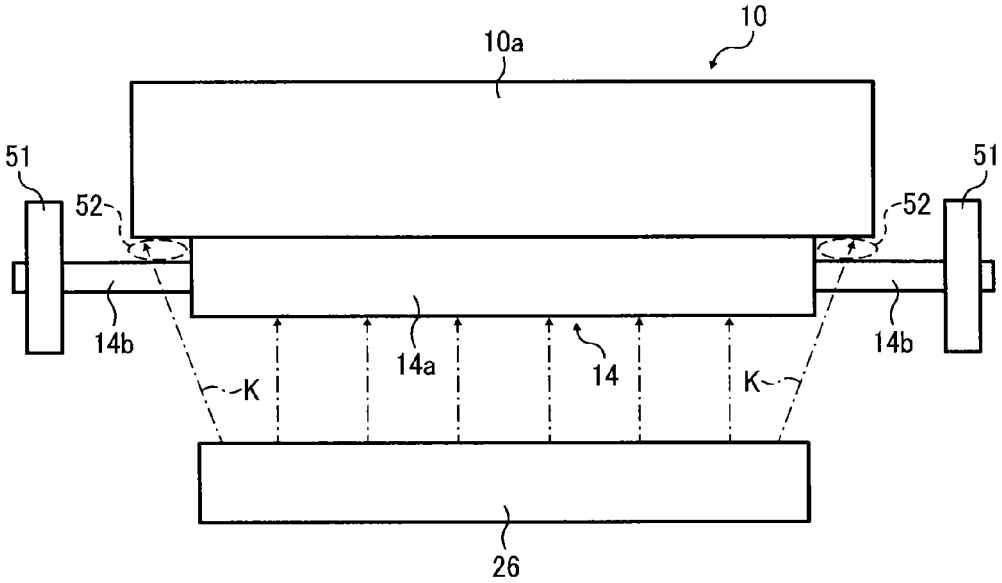
FIG. 22B is an enlarged view illustrating a problem that occurs when the cover is not provided.

In an eleventh embodiment, a transfer roller 14 serving as a transfer member forming a transfer nip N includes a shaft portion 14*b* rotatably supported by a frame 51 as illustrated in FIG. 22B. The axial length of a surface 14*a* of the transfer roller 14 in contact with a photoconductor surface 10*a* is smaller than the axial length of the photoconductor surface 10*a*, so that a gap 52 is created between the shaft portion 14*b* and the photoconductor surface 10*a*. With the gap 52 created, a charge-removing light source 26 disposed in the downstream of the transfer nip N in a recording-medium conveyance direction A emits a charge-removing light K, which is illustrated in a chained line in FIGS. 22A and 22B, that covers the entire axial length of the photoconductor surface 10*a*. The charge-removing light K leaks into the upstream in the recording-medium conveyance direction A directly or indirectly by reflection through the gap 52.

Figure 21:
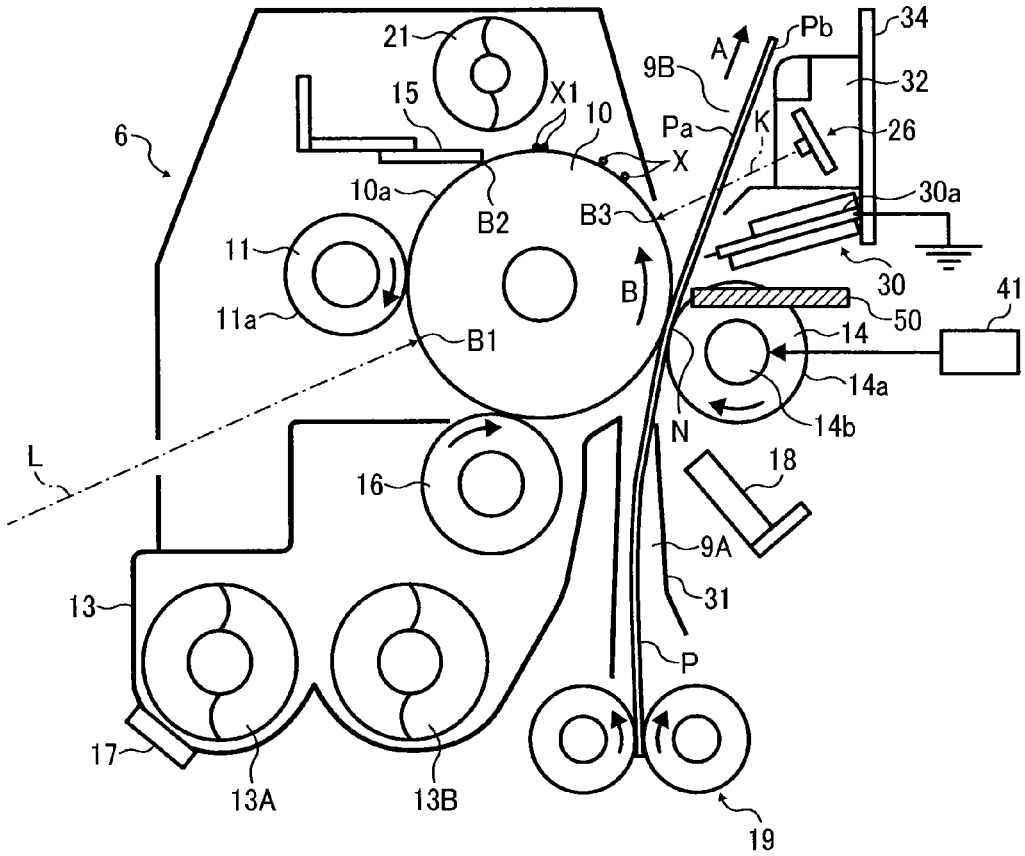
FIG. 21 is an enlarged view of an essential portion according to an eleventh embodiment of the present disclosure.

In the embodiment as illustrated in FIGS. 21 and 22A, a light shield 50 is provided as a shield that prevents the charge-removing light K emitted from the charge-removing light source 26 from leaking into the upstream of the transfer nip N in the recording-medium conveyance direction A so as the charge-removing light K not to reach a photoconductor 10, more preferably, the photoconductor surface 10*a* before transfer. The light shield 50 serves as a shield as well as a cover. Specifically, the light shield 50 having a form of a plate is disposed between the shaft portion 14*b* of the transfer roller 14 and the charge-removing light source 26. There is no limitation on the way the light shield 50 is provided. For example, the light shield 50 may be provided as a portion of the frame 51 to integrally constitute a transfer unit or may be attached to a frame 51 as an independent part.

It goes without saying that the light shield 50 has a sufficient length (lateral length) necessary for shielding the charge-removing light K. How to provide a sufficient length is not important. It is important to provide the light shield 50 as a shield in the downstream (upstream in FIG. 20) of the transfer nip N (specifically, the shaft portion 14*b* of the transfer roller 14) as illustrated in FIG. 20 to completely shield the charge-removing light K emitted from the charge-removing light source 26. Therefore, the light shield 50 is provided between the transfer nip N, which is the transfer position, and the charge-removing light source 26, which is a light irradiator. More particularly, the light shield 50 is provided between the gap 52 and the light source portion 26*a* of the charge-removing light source 26, where the gap 52 is created between the photoconductor 10 serving as an image bearer and the shaft portion 14*b* of the transfer roller 14 serving as a transfer member. The light shield 50 is disposed to face and cover the gap 52 with at least a portion of the light shield 50 in the irradiation range W1 of the charge-removing light source 26. The light shield 50 is provided to prevent direct and indirect irradiation of the photoconductor surface 10*a*, before transfer, with the charge-removing light K emitted from the charge-removing light source 26 so as to prevent the occurrence of a blurred image (image unevenness).

Figure 23:
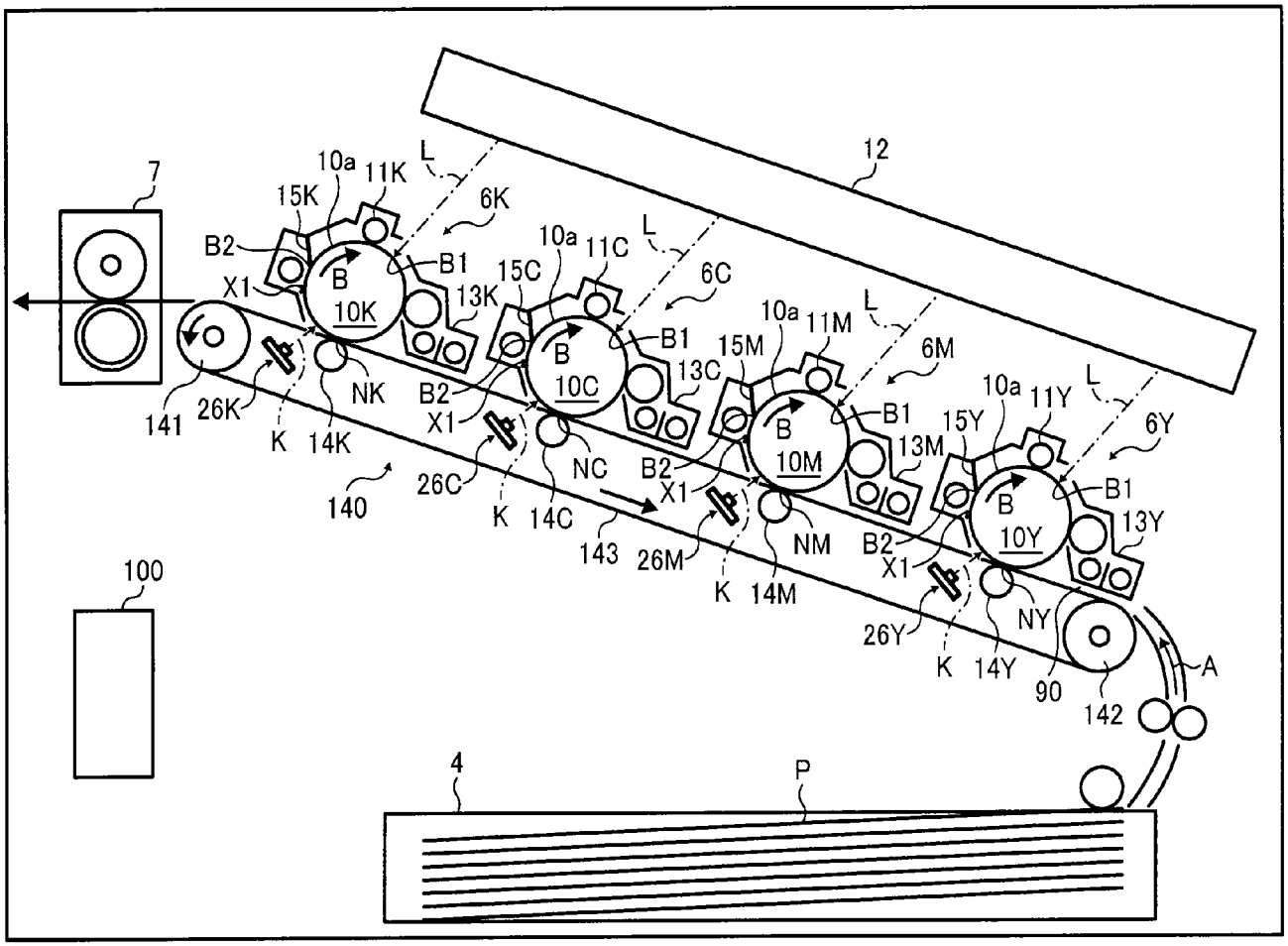
FIG. 23 is a schematic arrangement view illustrating another embodiment of the image forming apparatus according to the present disclosure.

Although the copier 1 using a single color toner is exemplarily described above as an image forming apparatus in the embodiments, the present disclosure is not only applicable to a single color copier but also may be applicable to, for example, a color copier 1A employing a tandem direct transfer system as illustrated in FIG. 23. The major components of the color copier 1A are image forming units 6Y, 6M, 6C, and 6K respectively using toners also serving as developers of yellow, magenta, cyan, and black (Y, M, C, K), a fixing device 7, an optical writing device 12, a conveyance unit 140 opposing the image forming units 6Y, 6M, 6C, and 6K, and a controller 100. The image forming units 6Y, 6M, 6C, and 6K respectively include drum-shaped photoconductors 10Y, 10M, 10C, and 10K each serving as an image bearer having a photoconductive layer on a surface 10*a*. The photoconductors 10Y, 10M, 10C, and 10K are each supported rotatable in a photoconductor rotating direction B, which is a clockwise direction in FIG. 23. The photoconductors 10Y, 10M, 10C, and 10K are each rotated in the photoconductor rotating direction B by a drive motor 40 serving as a drive source illustrated in FIG. 5. In the configuration illustrated in FIG. 23, four drive motors 40 are provided to independently rotate the photoconductors 10Y, 10M, 10C, and 10K. Charging rollers 11Y, 11M, 11C, and 11K each serving as a charger, a light-emission and exposure target B1 for a writing light L emitted from the optical writing device 12, developing devices 13Y, 13M, 13C, and 13K, transfer rollers 14Y, 14M, 14C, and 14K each serving as a transfer member, and cleaning blades 15Y, 15M, 15C, and 15K each serving as a cleaning member are arranged in series around the corresponding photoconductor according to the electrophotographic process. The transfer roller and the cleaning blade for each color are in contact with the corresponding photoconductor surface 10*a*.

The conveyance unit 140 forms a conveyance path 90 for conveying a recording medium P sent out from a tray 4 in the recording-medium conveyance direction A to transfer nips NY, NM, NC, and NK at which the transfer rollers 14Y, 14M, 14C, and 14K respectively oppose surfaces 10*a* of the photoconductors 10Y, 10M, 10C, and 10K. The conveyance unit 140 includes rollers 141 and 142 and a conveyance belt 143 that runs about the rollers 141 and 142 and circulates in the counterclockwise direction in FIG. 23. The conveyance belt 143 runs through gaps between the photoconductors 10Y, 10M, 10C, and 10K and the transfer rollers 14Y, 14M, 14C, and 14K to attract and convey the recording medium P. The conveyance belt 143 is a light transmissive member made of transparent material. The conveyance belt 143 serves as a guide in the embodiment.

In this configuration, charge-removing light sources 26Y, 26M, 26C, and 26K each emitting the charge-removing light K to the photoconductor surface 10*a* of the corresponding color are disposed in the inner side of the looped conveyance belt 143, that is, at the side of a back face Pb of the recording medium P, or the opposite side of the photoconductor surface 10*a* of the corresponding color relative to the conveyance path 90. Targeted between each of the transfer nips NY, NM, NC, and NK and the cleaning position B2 at which each of the cleaning blades 15Y, 15M, 15C, and 15K is in contact with the corresponding photoconductor surface 10*a*, the charge-removing light K is emitted onto the corresponding photoconductor surface 10*a* along the lateral direction. As a result, the adhesion force between the photoconductor surface 10*a* and an adhering substance X1 is reduced, and thereby the cleaning performance improves. The occurrence of black streaks is thus minimized. Furthermore, adhesion of scattered toner to the charge-removing light sources 26Y, 26M, 26C, and 26K is minimized and thus the device need not be made large in size, and at the same time, a sufficient emitted light amount from the charge-removing light source 26 is secured.

The preferable embodiments are described not by way of limiting the scope of the disclosure. Modifications and alterations of the embodiment can be made without departing from the spirit and scope described in the claims unless limited in the above description. For example, the image forming apparatus need not be a copier but may be a printer, an independent fax machine, or a multifunction peripheral including at least two functions of a copier, a printer, a fax machine, and a scanner. The effect obtained by the embodiment is described by way of examples of preferable effects obtained by the disclosure, not by way of limiting the effects obtainable by the present disclosure.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

a rotatable image bearer including a photoconductive layer;

a transfer member to form a transfer position at which a visible image on a surface of the image bearer is transferred to a recording medium conveyed through a conveyance path;

a cleaning member to form a cleaning position at which a substance adhering to the surface of the image bearer after transfer at the transfer position is cleaned;

a light irradiator disposed at a back face side of the recording medium opposite a side at which the surface of the image bearer is disposed relative to the conveyance path, the light irradiator configured to emit light onto the surface of the image bearer, the light being targeted between the transfer position and the cleaning position;

a light transmissive member disposed between the light irradiator and the image bearer; and a charge removing needle facing the conveyance path and disposed downstream from the transfer member along the conveyance path, wherein the light irradiator is disposed downstream from the charge removing needle along the conveyance path.

2. The image forming apparatus according to claim 1, wherein the light transmissive member is a guide to guide the recording medium.

3. The image forming apparatus according to claim 2, wherein the guide has a flat surface opposing a light source of the light irradiator.

4. The image forming apparatus according to claim 1, wherein a light source of the light irradiator is a light-emitting diode or an electro luminescence.

5. The image forming apparatus according to claim 1, wherein the light transmissive member covers an entire range of the light irradiator in a lateral direction of the light irradiator, the lateral direction intersecting a conveyance direction of the recording medium in a plane.

6. The image forming apparatus according to claim 1, further comprising:

a controller to control light emission of the light irradiator; and a drive source to rotate the image bearer, wherein the controller controls a light-emission timing of the light irradiator to synchronize with an actuating timing of a drive source.

7. The image forming apparatus according to claim 1, further comprising a controller to control light emission of the light irradiator, wherein the controller controls a light-emission timing of the light irradiator to synchronize with a timing of applying a transfer bias to the transfer member.

8. The image forming apparatus according to claim 1, further comprising a controller to adjust an amount of light emitted from the light irradiator.

9. The image forming apparatus according to claim 8, wherein the controller controls an amount of light from the light irradiator according to a conveyance timing of the recording medium.

10. The image forming apparatus according to claim 9, wherein the controller controls the light irradiator to emit a larger amount of light when the recording medium is conveyed through the conveyance path and a smaller amount of light when the recording medium is not conveyed through the conveyance path.

11. The image forming apparatus according to claim 8, further comprising a speed sensor to detect a rotation speed of the image bearer, wherein the controller controls the light irradiator to emit a larger amount of light as the rotation speed detected with the speed sensor is larger and a smaller amount of light as the rotation speed detected with the speed sensor is smaller.

12. The image forming apparatus according to claim 8, further comprising a condition detector to detect an environmental condition, wherein the controller controls an amount of light from the light irradiator according to a detection result of the condition detector.

13. The image forming apparatus according to claim 1, further comprising a charge remover to emit light onto the surface of the image bearer to remove a residual potential of the image bearer, the light being targeted between the cleaning position and a charged position of the image bearer.

14. The image forming apparatus according to claim 1, further comprising:

a separation-bias applicator to apply a separation bias to the charge remover, wherein the separation-bias applicator outputs a separation bias such that at least one of a separation bias applied to a leading end of the recording medium and a separation bias applied to a trailing end of the recording medium is larger than a separation bias applied to a middle portion of the recording medium.

15. The image forming apparatus according to claim 1, wherein the light irradiator is disposed at a position to emit light toward a rotational center of the image bearer.

16. The image forming apparatus according to claim 1, wherein the light transmissive member is made of a material having a polarity ranked in triboelectric series to a same negative or positive side as toner from the recording medium.

17. The image forming apparatus according to claim 1, wherein the light transmissive member has conductivity.

18. The image forming apparatus according to claim 1, further comprising a shield between the transfer position and the light irradiator.

19. The image forming apparatus according to claim 18, wherein the shield is disposed between a gap and the light irradiator, the gap disposed between the image bearer and the transfer member.

20. The image forming apparatus according to claim 19, wherein the shield is disposed to face and cover the gap and at least a portion of the shield is disposed within an irradiation range of the light irradiator.

21. The image forming apparatus of claim 1, wherein the transfer member is a transfer roller.

* * * * *